US007793656B2

(12) United States Patent
Johnson

(10) Patent No.: US 7,793,656 B2
(45) Date of Patent: Sep. 14, 2010

(54) UNDERWATER BREATHING DEVICES AND METHODS

(75) Inventor: Mark Johnson, Sandy, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/453,462

(22) Filed: Jun. 3, 2003

(65) Prior Publication Data

US 2004/0035414 A1 Feb. 26, 2004

Related U.S. Application Data

(60) Provisional application No. 60/385,327, filed on Jun. 3, 2002.

(51) Int. Cl.

| | |
|---|---|
| ***B63C 11/10*** | (2006.01) |
| ***B63C 11/16*** | (2006.01) |
| ***B63C 11/02*** | (2006.01) |
| ***A62B 18/10*** | (2006.01) |
| ***A62B 9/02*** | (2006.01) |
| ***B63G 8/40*** | (2006.01) |

(52) U.S. Cl. ..... 128/201.11; 128/201.27; 128/201.28; 128/205.24; 128/200.29; 114/327; 405/186; 405/187

(58) Field of Classification Search ..... 128/201.11, 128/201.27, 201.28, 205.24, 200.29; 114/327; 405/186, 187

See application file for complete search history.

(56) References Cited

U.S. PATENT DOCUMENTS

| | | | |
|---|---|---|---|
| 3,473,561 | A | 10/1969 | Svenson et al. |
| 3,860,042 | A | 1/1975 | Green |
| 3,949,780 | A | 4/1976 | Buckman |
| 3,993,060 | A | 11/1976 | Mitchell |
| 4,032,106 | A | 6/1977 | Schieser et al. |
| 4,066,077 | A | 1/1978 | Shamlian |

(Continued)

FOREIGN PATENT DOCUMENTS

| | | |
|---|---|---|
| GB | 1357249 | 6/1974 |

(Continued)

OTHER PUBLICATIONS

Fee et al., "Cardiorespiratory responses to increased expiratory resistance during excercise", Lung Mechanics, 5032.

(Continued)

*Primary Examiner*—Patricia M Bianco
*Assistant Examiner*—Nihir Patel
(74) *Attorney, Agent, or Firm*—Workman Nydegger

(57) ABSTRACT

A swim and skin-dive snorkel for providing positive end-expiratory pressure for pressure-balanced exhalation.

The snorkel may include inhalation and exhalation conduits. Air can be exhaled into a chamber and released when exhalation pressure within the chamber exceeds a threshold pressure. The threshold pressure that must be overcome to achieve exhalation may be balanced against the compressive forces of the ambient water pressure acting against the user's chest and lungs, which may greatly reduce the resting expiratory flow rate, the minute respiratory rate, and therefore the overall work of breathing. The exhalation pressure may be linearly matched to the ambient water pressure as a function of dive depth, thereby discouraging exhalation while diving. A purge valve may also be placed at the lower aspect of the snorkel.

43 Claims, 16 Drawing Sheets

U.S. PATENT DOCUMENTS

| | | | | | |
|---|---|---|---|---|---|
| 4,071,024 | A | | 1/1978 | Blanc | |
| 4,137,935 | A | | 2/1979 | Snowdon | |
| 4,143,853 | A | | 3/1979 | Abramson | |
| 4,230,240 | A | | 10/1980 | Laauwe | |
| 4,278,080 | A | | 7/1981 | Schuch | |
| 4,344,427 | A | | 8/1982 | Marvin | |
| 4,523,610 | A | | 6/1985 | Orrico | |
| 4,562,836 | A | | 1/1986 | Perron | |
| 4,610,246 | A | * | 9/1986 | Delphia | 128/201.11 |
| 4,655,212 | A | | 4/1987 | Delphia | |
| 4,708,135 | A | | 11/1987 | Arkema | |
| 4,731,075 | A | | 3/1988 | Gallo Mezo et al. | |
| 4,782,830 | A | | 11/1988 | Forman | |
| 4,793,341 | A | | 12/1988 | Arasmith | |
| 4,805,610 | A | | 2/1989 | Hunt | |
| 4,832,013 | A | | 5/1989 | Hartdorn | |
| 4,834,084 | A | | 5/1989 | Walsh | |
| 4,860,739 | A | | 8/1989 | Vandepol | |
| 4,862,903 | A | | 9/1989 | Campbell | |
| 4,872,453 | A | | 10/1989 | Christianson | |
| 4,877,022 | A | | 10/1989 | Christianson | |
| 4,878,491 | A | | 11/1989 | McGilvray, III | |
| 4,879,995 | A | | 11/1989 | Christianson | |
| 4,884,564 | A | | 12/1989 | Lamont | |
| 4,896,664 | A | | 1/1990 | Harayama | |
| 4,907,582 | A | | 3/1990 | Meyerrose | |
| 4,938,259 | A | | 7/1990 | Schmidt | |
| 4,946,133 | A | | 8/1990 | Johnson et al. | |
| 5,020,191 | A | | 6/1991 | Uke | |
| 5,101,818 | A | | 4/1992 | Chace | |
| 5,117,817 | A | | 6/1992 | Lin | |
| 5,129,426 | A | | 7/1992 | Boehmer | |
| 5,143,059 | A | | 9/1992 | Delphia | |
| 5,199,422 | A | | 4/1993 | Rasocha | |
| 5,231,982 | A | * | 8/1993 | Harrison et al. | 128/207.12 |
| 5,239,990 | A | | 8/1993 | Delphia | |
| 5,245,997 | A | | 9/1993 | Bartos | |
| 5,261,396 | A | * | 11/1993 | Faulconer et al. | 128/201.11 |
| 5,265,591 | A | | 11/1993 | Ferguson | |
| 5,267,556 | A | | 12/1993 | Feng | |
| 5,271,432 | A | | 12/1993 | Gueret | |
| 5,280,785 | A | | 1/1994 | Fujima | |
| 5,297,545 | A | | 3/1994 | Infante | |
| 5,327,849 | A | | 7/1994 | Miller | |
| 5,357,654 | A | | 10/1994 | Hsing-Chi | |
| 5,381,563 | A | | 1/1995 | Isabelle et al. | |
| 5,398,673 | A | * | 3/1995 | Lambert | 128/202.28 |
| 5,404,872 | A | | 4/1995 | Choi | |
| 5,487,379 | A | | 1/1996 | Koshiishi | |
| 5,518,026 | A | | 5/1996 | Benjey | |
| 5,529,057 | A | | 6/1996 | Ferrero | |
| 5,606,967 | A | | 3/1997 | Wang | |
| 5,622,165 | A | * | 4/1997 | Huang | 128/201.11 |
| 5,638,811 | A | | 6/1997 | David | |
| 5,657,746 | A | * | 8/1997 | Christianson | 128/201.11 |
| 5,664,558 | A | | 9/1997 | Wagner | |
| 5,671,728 | A | * | 9/1997 | Winefordner et al. | 128/201.11 |
| 5,697,362 | A | | 12/1997 | Albrecht | |
| 5,791,524 | A | | 8/1998 | Demarest | |
| 5,865,169 | A | | 2/1999 | Lan | |
| 5,868,129 | A | * | 2/1999 | Christianson | 128/201.11 |
| D406,333 | S | | 3/1999 | Garraffa | |
| 5,893,362 | A | | 4/1999 | Evans | |
| 5,906,199 | A | | 5/1999 | Budzinski | |
| 5,924,416 | A | | 7/1999 | Miller | |
| 5,937,850 | A | | 8/1999 | Kawashima | |
| 5,947,116 | A | | 9/1999 | Gamow | |
| 5,960,791 | A | | 10/1999 | Winefordner | |
| 6,059,157 | A | | 5/2000 | Parsons et al. | |
| 6,073,626 | A | | 6/2000 | Riffe | |
| 6,079,410 | A | | 6/2000 | Winefordner et al. | |
| 6,085,744 | A | | 7/2000 | Hermansen et al. | |
| 6,119,685 | A | | 9/2000 | Kawashima | |
| 6,123,320 | A | | 9/2000 | Rasanow et al. | |
| 6,129,081 | A | | 10/2000 | Wu | |
| 6,129,116 | A | | 10/2000 | Laskowski | |
| 6,202,644 | B1 | | 3/2001 | Takeuchi | |
| 6,240,962 | B1 | | 6/2001 | Tai et al. | |
| 6,273,046 | B1 | | 8/2001 | Pierce | |
| 6,276,362 | B1 | | 8/2001 | Chen-Lieh | |
| 6,302,102 | B1 | | 10/2001 | Giroux | |
| 6,318,363 | B1 | | 11/2001 | Monnich | |
| 6,352,075 | B1 | | 3/2002 | Wang | |
| 6,363,929 | B1 | | 4/2002 | Winefordner | |
| 6,371,108 | B1 | | 4/2002 | Christianson | |
| 6,394,417 | B1 | | 5/2002 | Browne | |
| 6,401,711 | B1 | | 6/2002 | Tibbs | |
| 6,435,178 | B1 | | 8/2002 | Lin | |
| 6,478,024 | B1 | | 11/2002 | White | |
| 6,513,520 | B2 | | 2/2003 | Vinokur et al. | |
| 6,516,797 | B2 | * | 2/2003 | Chen-Lieh | 128/201.11 |
| 6,655,378 | B2 | * | 12/2003 | Swetish | 128/201.11 |
| 6,709,604 | B2 | | 3/2004 | Tai et al. | |
| 6,736,136 | B2 | | 5/2004 | Chen-Lieh | |
| 6,827,105 | B1 | | 12/2004 | Marble et al. | |
| 6,883,780 | B2 | | 4/2005 | Browne et al. | |
| 6,908,210 | B2 | | 6/2005 | Kuo | |
| 6,915,801 | B2 | | 7/2005 | Pokras | |
| 7,185,796 | B2 | | 3/2007 | Parsons | |
| 2002/0088460 | A1 | | 7/2002 | Monnich | |
| 2002/0170558 | A1 | | 11/2002 | Vinokur | |
| 2003/0029448 | A1 | | 2/2003 | Swetish | |
| 2003/0037783 | A1 | | 2/2003 | Feng | |
| 2004/0035414 | A1 | | 2/2004 | Johnson | |
| 2005/0034726 | A1 | | 2/2005 | Pittaway et al. | |
| 2006/0102176 | A1 | | 5/2006 | Junck | |
| 2006/0272637 | A1 | | 12/2006 | Johnson | |

FOREIGN PATENT DOCUMENTS

| | | |
|---|---|---|
| GB | 2171781 | 9/1986 |
| GB | 2313317 | 11/1997 |
| JP | 10-299922 | 11/1998 |
| JP | 2004-169748 | 6/2004 |
| TW | 573667 | 1/2004 |
| TW | M248730 | 11/2004 |
| TW | M252649 | 12/2004 |
| WO | WO 2006/042063 | 4/2006 |
| WO | WO 2006/127556 | 11/2006 |
| WO | WO 2006/127557 | 11/2006 |

OTHER PUBLICATIONS

Ellingsen, "The influence on the breathing pattern in man of moderate levels of continuous positive and negative airway pressure . . . ", ACTA Physiol Scand 1990, 138, 273-282.

Van Der Schans, "Effect of positive expiratory pressure on breathing pattern in healthy subjects", Eur Respir J, 1993, 6, 60-66.

Layon et al., "Continuous positive airway pressure and expiratory positive airway pressure . . . ", CHEST, 89/4/Apr. 1986, p. 517.

Tobin et al., "Effect of positive end-expiratory pressure on breathing patterns of normal . . . ", Critical Care Medicine, 1983, p. 859, vol. 11-No. 11, Williams & Wilkins Co.

Savourey et al., "Positive end expiratory pressure (PEEP) slightly modifies . . . ", Aviation, Space, and Environmental Medicine, Jan. 2001, p. 21, vol. 72-No. 1.

Muller, "A field study of the ventilatory response to ambient temperature . . . ", Br. J. Sports Med., 1995, vol. 29, No. 3, p. 185-190, Butterworth Heinemann.

U.S. Appl. No. 11/244,522, filed Oct. 6, 2005, Johnson.

U.S. Appl. No. 11/248,900, filed Oct. 11, 2005, Johnson.

U.S. Appl. No. 11/437,113, filed May 18, 2006, Johnson.

U.S. Appl. No. 11/923,423, filed Oct. 24, 2007, Johnson.

Office Action dated Oct. 17, 2007 from U.S. Appl. No. 11/244,522, 8 pages.

Office Action dated May 24, 2007 from U.S. Appl. No. 11/244,522, 5 pages.
International Search Report from PCT/US2005/036072 dated Dec. 8, 2006, 2 pages.
International Preliminary Report on Patentability from PCT/US2005/036072 dated Apr. 11, 2007, 6 pages.
Written Opinion from PCT/US2005/036072 dated Sep. 25, 2006, 5 pages.
Office Action dated Aug. 23, 2006 from U.S. Appl. No. 11/244,522, 7 pages.
International Search Report from PCT/US2006/019658 dated Dec. 13, 2006, 2 pages.
International Preliminary Report on Patentability from PCT/US2006/019658 dated Nov. 23, 2007, 4 pages.
Written Opinion from PCT/US2006/019658 dated Oct. 28, 2006, 3 pages.
International Search Report from PCT/US2006/019659 dated Jul. 27, 2007, 2 pages.
International Preliminary Report on Patentability from PCT/US2006/019659 dated Nov. 23, 2007, 5 pages.
Written Opinion from PCT/US2006/019659 dated May 29, 2007, 4 pages.
International Search Report and Written Opinion from PCT/US2008/054475, dated Aug. 15, 2008, 11 pages.
U.S. Appl. No. 12/034,617, filed Feb. 20, 2008, Johnson.
International Search Report and Written Opinion from PCT/US2007/082520, dated May 7, 2008, 10 pages.
Search Report from Taiwan Application No. 095118125, dated Feb. 18, 2008, 1 page.
Office Action from Chinese Patent Application No. 2006800176981, dated Apr. 24, 2009, 9 pages.
Office Action from Australian Patent Application No. 2006251592, dated May 7, 2009, 1 page.
Office Action from Australian Patent Application No. 2006251593, dated May 19, 2009, 2 pages.
Examination Report for Singapore Patent Application No. 200717891-6, dated Jan. 29, 2009, 5 pages.
International Preliminary Report on Patentability from PCT/US0228/054475, dated Aug. 26, 2009, 8 pages.
Examination Report from Canadian Patent Application No. 2,609,479, dated Aug. 27, 2009, 4 pages.
Examination Report from Canadian Patent Application No. 2,609,204 dated Sep. 23, 2009, 2 pages.
Examination Report from New Zealand Patent Application No. 563367 dated Aug. 18, 2009, 2 pages.
Examination Report from New Zealand Patent Application No. 563368 dated Aug. 19, 2009, 2 pages.
European Search Report from EPO Patent Application No. 06770786.9 dated Aug. 5, 2009, 6 pages.
Office Action from U.S. Appl. No. 11/248,900 dated Oct. 16, 2009, 6 pages.

* cited by examiner

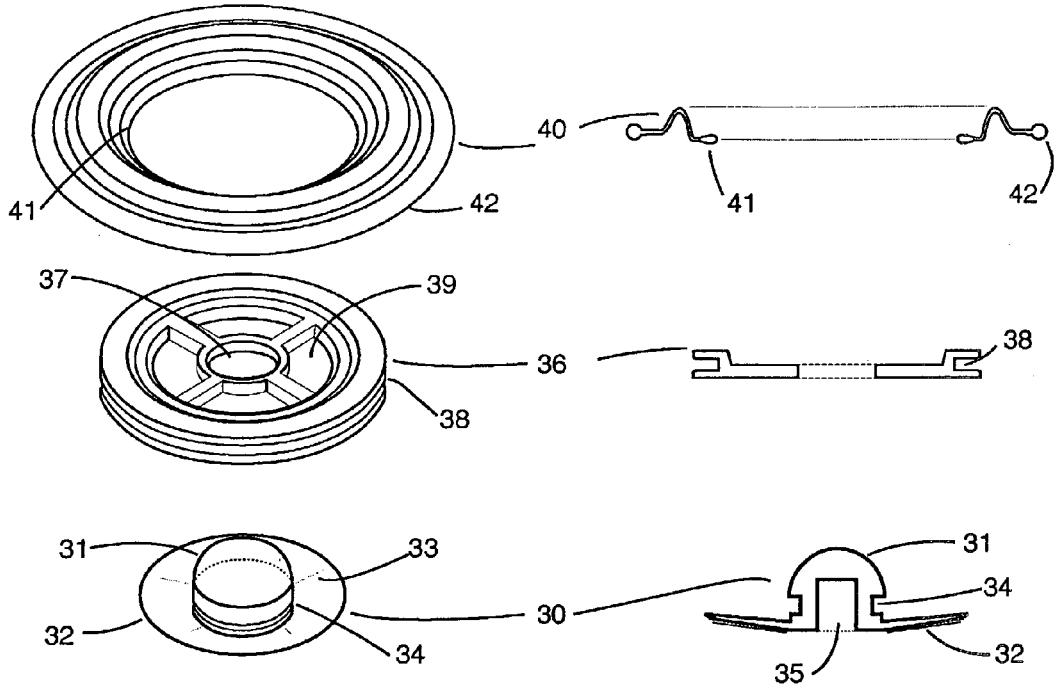
FIG. 5B
FIG. 5C
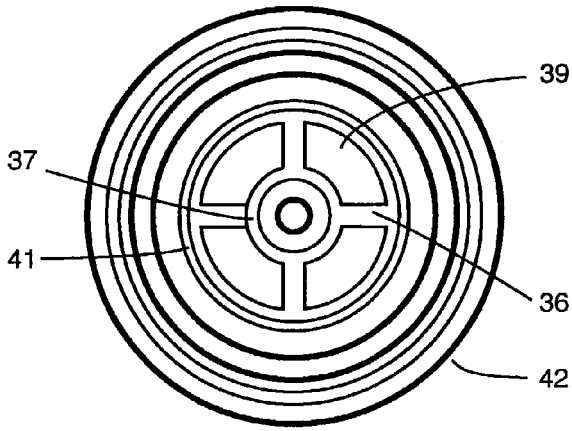
FIG. 5D
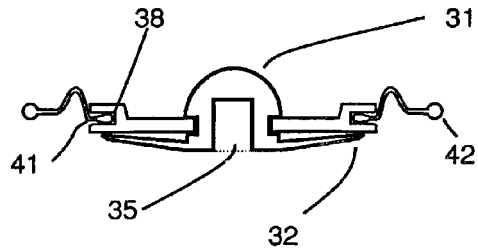
FIG. 5E

UNDERWATER BREATHING DEVICES AND METHODS

CROSS REFERENCE TO RELATED APPLICATIONS AND PRIORITY CLAIM

This application claims the benefit of the following provisional patent application: U.S. Provisional Application No. 60/385,327, filed Jun. 3, 2002. This provisional patent application and its disclosures and drawings are incorporated by reference herein.

FIELD OF THE INVENTIONS

The present inventions relate to devices for underwater breathing equipment (including snorkels, scuba regulators, and scuba equipment) and to related methods, in particular to devices and methods intended to increase performance, enhance comfort and/or improve breathing while immersed or submersed in water.

BACKGROUND AND INTRODUCTION

The basic snorkel, which facilitates breathing atmospheric air while the face is submersed in a body of water, has been present for centuries of time. In a common and simple form, the snorkel includes a breathing conduit. The breathing conduit typically has a mouthpiece connected to one end of the conduit. The other end of the conduit is positioned in the air above the water and the user's head to allow inhalation of air while the user's face or mouth is underwater.

The basic snorkel has been improved, enhanced and built upon over the years. Many designs, structures and modifications to snorkels have been created to improve or enhance the experience of the user while swimming and/or diving. Some of the more relevant patents and published patent applications include:

| U.S. PATENTS | |
|---|---|
| 3,860,0421/1975 | Green |
| 3,993,06011/1976 | Mitchell |
| 4,066,0771/1978 | Shamlian |
| 4,071,0241/1978 | Blanc |
| 4,278,0807/1981 | Schuch |
| 4,344,4278/1982 | Marvin |
| 4,610,2469/1986 | Delphia |
| 4,655,2124/1987 | Delphia |
| 4,708,13511/1987 | Arkema |
| 4,782,83011/1988 | Forman |
| 4,793,34112/1988 | Arasmith |
| 4,805,6102/1989 | Hunt |
| 4,832,0135/1989 | Hartdorn |
| 4,834,0845/1989 | Walsh |
| 4,884,56412/1989 | Lamont |
| 4,896,6641/1990 | Harayama |
| 4,860,7398/1989 | Vandepol |
| 4,862,9039/1989 | Campbell |
| 4,872,45310/1989 | Christianson |
| 4,877,02210/1989 | Christianson |
| 4,878,49111/1989 | McGilvray, III |
| 4,879,99511/1989 | Christianson |
| 5,101,8184/1992 | Chace, et al |
| 5,117,8176/1992 | Lin |
| 5,143,0599/1992 | Delphia |
| 5,199,4224/1993 | Rasocha |
| 5,239,9908/1993 | Delphia |
| 5,261,39611/1993 | Faulconer et al |
| 5,265,59111/1993 | Ferguson |
| 5,267,55612/1993 | Feng |
| 5,280,7851/1994 | Fujima |

-continued

| U.S. PATENTS | |
|---|---|
| 5,297,5453/1994 | Infante |
| 5,327,8497/1994 | Miller |
| 5,357,65410/1994 | Hsing-Chi |
| 5,404,8724/1995 | Choi |
| 5,487,3791/1996 | Koshiishi |
| 5,529,0576/1996 | Ferrero et al |
| 5,606,9673/1997 | Wang |
| 5,622,1654/1997 | Huang |
| 5,638,8116/1997 | David |
| 5,657,7468/1997 | Christianson |
| 5,664,5589/1997 | Wagner |
| 5,671,7289/1997 | Winefordner et al |
| 5,697,36212/1997 | Albrecht |
| 5,865,1692/1999 | Lan et al |
| 5,868,1292/1999 | Christianson |
| 5,893,3624/1999 | Evans |
| 5,924,4167/1999 | Miller |
| 5,937,8508/1999 | Kawashima et al |
| 5,947,1169/1999 | Gamow et al |
| 5,960,79110/1999 | Winefordner et al |
| 6,119,6859/2000 | Kawashima et al |
| 6,129,08110/2000 | Wu |
| 6,202,644 B1 3/2001 | Takeuchi et al |
| 6,276,362 B1 8/2001 | Chen-Lieh |
| 6,302,102 B1 10/2001 | Giroux et al |
| 6,318,363 B1 11/2001 | Monnich |
| 6,352,075 B1 3/2002 | Wang |
| 6,363,929 B1 4/2002 | Winefordner et al |
| 6,371,108 B1 4/2002 | Christianson |
| 6,401,711 B1 6/2002 | Tibbs et al |
| 6,435,178 B1 8/2002 | Lin |
| 6,478,024 B1 11/2002 | White, Jr |
| 2002/0088460 A1 | 7/2002 Monnich |
| 2002/0170558 A1 | 11/2002 Vinokur et al |
| 2003/0029448 A1 | 2/2003 Swetish |
| 2003/0037783 A1 | 2/2003 Feng |

As is evident from the above patents, numerous problems have been addressed by various snorkel designs. However, to the best of this inventor's knowledge, no attention has been given to the physiologic impact of the compressive forces of ambient water on the respiration, specifically in exhalation, of the user of a surface-breathing, or near-surface breathing, snorkel.

Scuba regulators, scuba equipment, snuba tubes and other snuba equipment are well known to persons of ordinary skill in the art. Embodiments of my invention can be adapted for use with the foregoing as well as new innovations in these areas.

Several devices in the related field of "snuba" have confirmed that pressure-assistance is necessary to facilitate inhalation at the modest depths achieved with snuba. But once again, to the best of this inventor's knowledge, no attention has been given to the expiratory flow rate at such depths. Even scuba regulators, which facilitate inhalation at much greater depths, have not, to the best of this inventor's knowledge, specifically addressed the greatly increased expiratory flow rates that naturally occur at these even greater depths.

In the case of the snorkel the user is typically in either a state of immersion (meaning that the body is within the water, while the airways communicate at atmospheric pressure) or in a state of submersion (meaning that both the body and the airways are exposed to ambient water pressure). From a practical standpoint for a snorkel user, most respiration necessarily occurs while surface swimming in the state of immersion. In this state, the conventional snorkel exchanges air at atmospheric pressure with the lungs, which lungs are acted upon by the greater compressive pressures of ambient water. Hence, compared to being completely out of the water, a greater effort is required to expand the lungs in inspiration and a lesser effort is required for exhalation, i.e., the expiratory flow rate is faster than the inhalation flow rate. Inasmuch as inhalation occupies only a small temporal component of the complete respiratory cycle, this faster exhalation component also results in a substantially shorter respiratory cycle and more inhalations per minute. In addition, as the user is exposed to the compressive effects of the ambient water pressure, during inhalation, a greater work of breathing is incurred and, over time, his or her inspiratory muscles progressively fatigue, resulting in smaller functional lung capacity, a relatively greater adverse contribution of the snorkel and bronchial dead spaces with each breath, and the possibility of atelectasis (collapse of the alveolar/gas exchange sacs).

Embodiments of the snorkel presented herein can serve to substantially reduce the overall work of breathing by balancing the expiratory forces, slowing the respiratory cycle, reducing the repetitive work of inhalation against compressive ambient water pressures, and/or minimizing the risk of developing atelectasis.

Furthermore, several other benefits may be realized by embodiments of my invention. By increasing the pressure within the snorkel's main (inhalation) tube, the inhalation valve at the top end of tube can be maintained in a closed position, except during active inhalation, thereby significantly reducing the internal exposure to splash water, and even reducing the internal exposure to flood water upon submersion; however, the inhalation valve does not absolutely close while submersed, beneficially allowing the user to voluntarily draw on a small amount of residual air. The pressure amounts to positive end-expiratory pressure ("PEEP") which may result in physiologic benefit to some users, particularly those with obstructive lung diseases, such as asthma and emphysema.

Many aspects of human physiology become involved here, but in a simplistic overview, PEEP slows respiratory rate and tends to increase functional lung volumes, but also tends to slow venous blood return to the heart. In the water, however, venous blood return to the heart is already greatly improved simply by the compressive forces of ambient water. A slowed respiratory rate is preferred as each inhalation must displace water, significantly increasing the work of breathing, inspiratory muscle fatigue, and the associated anxiety that accompanies many skin divers. Furthermore, the increase in lung volume, time-averaged over the complete respiratory cycle, enhances the buoyancy of the user.

OBJECTS OF THE INVENTIONS

It is an object of the present inventions to provide devices that effect an improved balance between the intrinsic airway pressures of physiologic exhalation and the competing extrinsic pressures of ambient water acting on the chest wall. Embodiments of these inventions can be incorporated in or used in conjunction with underwater breathing equipment such as snorkels, scuba regulators and snuba equipment.

It is a further object of the present inventions to provide devices that minimize the re-breathing of exhaled air. Unidirectional air flowing into the snorkel via one conduit and exiting the snorkel via a separate conduit can be employed for this purpose. Unique to the present invention is the use of ambient water pressure and/or other counter pressure to maintain a pressure and to retain exhaled air until the airway exhalation forces are adequate to overcome the compressive forces of ambient water pressure on the user.

It is yet another object of the present inventions to provide snorkel devices that maintain internal dryness while swimming in turbulent water and while diving. Splash water is blocked from entering the snorkel, except during inhalation; and any water that accumulates in the purge reservoir is purged from the snorkel during normal, relaxed exhalation, even before any exhaled air is positioned to leave the snorkel.

Through embodiments of my invention many tangible benefits are provided to the user including a reduction in resting respiratory rate with a resultant reduction in the work of breathing, reduction in anxiety, improvement in the sense of safety and well-being, longer dive times, and a drier snorkel.

It is also another object of certain embodiments of my invention to similarly balance the exhalation rate of the underwater scuba diver by attaching a device patterned after the exhalation valve of this snorkel to the exhalation port of the scuba regulator to similarly regulate the natural exhalation rate of the scuba diver or snuba diver.

These objects and other objects, purposes and advantages of my invention are apparent from the descriptions and drawings herein. My inventions are not limited to or by these objects and not every embodiment of my invention necessarily incorporates or provides every such object, purpose or advantage.

SUMMARY

This summary provides a general description of different aspects of my invention, including certain embodiments or elements of my invention. This summary is not intended to limit the scope of my invention, nor is there any implication that my invention requires all of the described or identified aspects or elements. Various options and alternatives are described and are not intended to limit the scope of my invention or claims.

The invention provides positive end-expiratory pressure to the respiratory passages of a user of underwater breathing equipment. The underwater breathing equipment can be, for example, a snorkel, a scuba regulator or snuba equipment. My invention can be adapted for use with, or to be incorporate in, these and similar underwater breathing equipment.

The invention includes a chamber into which air is exhaled by the user and a means for releasing the exhaled air from the chamber and away from the user when exhalation pressure within the chamber exceeds a counter pressure exerted on the exhalation pressure. The chamber can be any conduit, vessel, container or other space where exhaled air can be received and contained, at least temporarily. An exhalation pressure within the chamber is created, i.e., exhalation pressure is the pressure in the chamber into which the air is exhaled. This inventive device can provide positive end-expiratory pressure to the respiratory passages of the user during exhalation.

The means for releasing the exhaled air can include a valve adapted to open when the exhalation pressure exceeds the counter pressure. The valve can be any valve, nozzle or other device for regulating or controlling the release of exhaled air from the chamber. This valve may include a pressure member against which the counter pressure acts; whereby exhaled air is released from the chamber when the exhalation pressure acting against the pressure member exceeds the counter pressure. The counter pressure is (or defines) the resistance which the exhalation pressure must overcome in order to provide or allow a release of exhaled air from the chamber.

The counter pressure can be a pressure (predetermined or not) created or dictated by mechanical means, such as a spring, a biased structure, or other physical structure adapted to provide the resistance which the exhalation pressure must overcome for a release of exhaled air from the chamber. Although not preferred, pneumatic, hydraulic or other forces or devices for applying or creating this counter pressure against the exhalation pressure can be used. Most preferably the counter pressure is created or provided in whole or in part by ambient water pressure. Ambient water pressure can act directly or indirectly against a pressure member to provide a counter pressure against the exhalation pressure in the chamber. The pressure member can be a disk, plate, ring, or other physical structure exposed directly or indirectly to the ambient water pressure and/or other counter pressure. The pressure member applies the counter pressure against the exhalation pressure in the chamber.

In an alternative embodiment of this invention, the exhaled air is not released until the exhalation pressure in the chamber exceeds a threshold pressure. The threshold pressure may be pre-determined or may vary depending on conditions such as ambient water pressure. When the exhalation pressure in the chamber exceeds the threshold pressure, the exhaled air is released. Although not preferred, a sensor or other device can determine if or when the threshold pressure has been exceeded by the exhalation pressure, and when exceeded the exhaled air is released from the chamber.

The release of exhaled air from the chamber can be prevented or inhibited until the counter pressure or threshold pressure is exceeded or overcome by the exhalation pressure. Although it is preferred that the release be prevented, the invention retains some of its advantages and benefits even if the release is just substantially inhibited, i.e., release of exhaled air from the chamber is substantially inhibited, but not totally prevented. This inhibited release may occur when the valve is in the form of a nozzle or other device that allows for a very limited release of exhaled air from the chamber when the exhalation pressure does not exceed or overcome the counter pressure or threshold pressure, but the inhibition is sufficient to provide additional pressure and PEEP.

The invention may include a pressure system that provides additional pressure or the counter pressure. The pressure system may include the pressure member described above and further described below. The pressure system is the means by which the counter pressure is applied to the exhalation pressure in the conduit. It may also be the means by which a threshold pressure may be established.

Preferably, the pressure member moves in response to a difference in pressure between the exhalation pressure in the chamber and the counter pressure. A counter pressure such as pressure from ambient water may act directly or indirectly on the pressure member.

Preferably, a sealing member may be connected to or be part of the pressure member or may through other means be controlled by or responsive to the pressure member or movement of the pressure member. The sealing member acts to regulate the release of exhaled air from the chamber by closing or sealing an exit from the chamber. When the chamber is connected to an exhalation conduit (see description below), the sealing member can act to close or seal the entrance to the exhalation conduit when the exhalation pressure does not exceed the counter pressure or threshold pressure. When the counter pressure or threshold pressure is exceeded, the sealing member can open the entrance to the exhalation conduit allowing exhaled air to enter the exhalation conduit. The sealing member can be any shape suited for the closing or sealing purpose. Preferably, the sealing member is dome shaped or similarly shaped to provide for a gradual, rather than sudden, release of exhaled air until the sealing member is sufficiently separated from the exhalation conduit's entrance, thereby preventing or reducing vibration or buzz that would otherwise occur.

My invention can be applied to snorkels. The snorkels of my invention can include (a) an inhalation conduit adapted to receive inhaled air upon inhalation by a user of the snorkel, and (b) an exhalation conduit adapted to receive exhaled air from the user and to direct the exhaled air under additional pressure out of the snorkel, and (c) a pressure system to apply the additional pressure. This can achieve PEEP for the user.

Preferably the inhalation conduit has an inhalation valve (diaphragm, butterfly, umbrella, or otherwise). The inhalation valve is adapted to open to allow inhalation of air, but at other times is closed to maintain pressure within the snorkel. This inhalation valve and the associated inhalation conduit should be adequately sized to minimize inhalation resistance and the valve should close tightly during exhalation to maintain pressure within the snorkel and directional airflow through the snorkel.

The snorkel may also have an exhalation valve which is adapted to be acted upon by a counter pressure to regulate the receipt of exhaled air by the exhalation conduit. The exhalation valve may be adapted to provide exhaled air into the exhalation conduit when the pressure of the exhaled air exceeds the counter pressure. Preferably this counter pressure is generated in whole or in part by ambient water pressure.

The snorkel may include the pressure system or pressure member described above. The counter pressure acts against this pressure member to provide the additional pressure. Alternatively, the counter pressure can act as the pressure member to provide the additional pressure.

Preferably, the exhalation conduit is within the inhalation conduit, but alternatively may be outside of or external to the inhalation conduit. The exhalation conduit preferably originates near the lower end of the snorkel, in sealing proximity to a sealing member of the exhalation valve.

The inhalation and exhalation conduits are preferably tubes of plastic, rubber or other material. Plastics or other materials commercially used in snorkels can be used. The conduit may be any conduit, tube, passageway or other means of conveyance through which inhaled air or exhaled air can flow. Conventional tubes used for snorkels are generally suitable.

A preferred exhalation valve useful in the practice of this invention includes the following:

1. A sealing member, which facilitates a physical closure or seal against the release of exhaled air from the chamber. This closure or seal may be applied directly against the exhalation conduit or against some connection or intermediary between the chamber and exhalation conduit. For example, the seal may be applied to a mount to which the exhalation conduit is attached. This sealing member has a preferred dome shape which gradually increases the escape of the pressurized air within the snorkel at the opening pressure of the valve, thereby minimizing or eliminating the vibratory buzz that would otherwise be experienced. Alternative shapes for the sealing member include that of a teardrop, a cone, or similar shape such that elimination of the vibratory buzz is accomplished.

2. A rigid support disk, which provides structural support to the softer sealing member and provides a rigid surface upon which ambient water pressure can act to generate a counter pressure.

3. A convoluted membrane, which is generally annular in shape and serves to flexibly attach the rigid support disk/sealing member assembly to the rigid and stationary lower housing an example of which is described below. The convoluted cross-section of this membrane allows sufficient non-impeded axial travel of the sealing member such that the sealing member can both tightly seal against the exhalation conduit mount and can also move outwardly sufficient to non-obstructively open the valve at the mount.

A purge valve is preferably included for purging water from the snorkel. The purge valve can be used with or can be incorporated into the exhalation valve apparatus. The purge valve provides for the purging of water from the snorkel. To accomplish this, an excessive exhalation pressure is required. For example, normal exhalation may result in an exhalation pressure that exceeds the counter pressure or threshold pressure, but is insufficient to exceed or overcome the pressure required for a purge. To purge, the user must exert an excessive exhalation pressure sufficient to exceed or overcome the pressure required for purging of water through the purge valve. In other words, the purge pressure is greater than the counter pressure such that the exhalation pressure required to purge water from the snorkel is greater than the exhalation pressure required to exceed the counter pressure for a release of exhaled air from the chamber into the exhalation conduit.

A preferred purge valve includes:

1. Rapid purge channels in the exhalation valve's rigid support disk.

2. A purge membrane, which is materially contiguous with the exhalation valve's sealing member and which covers the underside of the rapid purge channels of the rigid support disk, thereby preventing ambient water entry into the snorkel. This purge membrane also has a molded bias for closure to remain closed at normal exhalation pressures, but to open with the greater pressures of rapid purging operations. To purge, the user must exert an excessive exhalation pressure sufficient to exceed or overcome the pressure required for purging of water through the rapid purge channels.

3. Purge membrane ribs which orient radially and which provide circumferentially non-uniform pressure release across the Rapid Purge Channels, thereby minimizing the buzz or vibration that otherwise would be experienced In another exemplary embodiment of my invention, the exhalation valve apparatus and the purge valve are molded together into a single piece of flexible rubber or plastic, comprising a cylindrical wall shaped as an accordion, which allows compressible axial movement, and a circular diaphragm, which is molded to be contiguous with the cylindrical accordion wall that it closes. A central dome is molded into the upper surface of the circular diaphragm area, which serves as the sealing member of the exhalation valve. The outer folds on the cylindrical accordion wall have several small slits, which effectively function as small duck valves for rapid purging when the accordion wall is extended, as in higher pressure purge operations.

Portions of the above described snorkel (e.g., exhalation valve) can be applied or adapted to a scuba regulator or snuba equipment (e.g., snuba tube), i.e., used in conjunction with the scuba regulator or snuba equipment. The user breathes air from the scuba regulator or snuba tube (inhalation), but exhalation of air by the user encounters a counter pressure to create PEEP in the respiratory system of the user. The exhaled air from the user enters a chamber and there is an exhalation pressure. A pressure system provides a counter pressure. The exhaled air is released from the chamber when the exhalation pressure exceeds the counter pressure (or a threshold pressure). The exhalation valve with sealing member and pressure member can be adapted and used for this purpose.

BRIEF DESCRIPTION OF THE DRAWINGS

FIG. 4B is a sectional view of the connecting tube shown in FIG. 4A.

FIG. 5B is an exploded perspective view of the exhalation valve/purge valve assembly.

FIG. 5C is an exploded transverse sectional view of the exhalation valve/purge valve assembly FIG. 5D shows the top view of this exhalation valve/purge valve assembly FIG. 5E shows a collapsed transverse sectional view of the exhalation valve/purge valve assembly

DETAILED DESCRIPTION

Figure 1A:
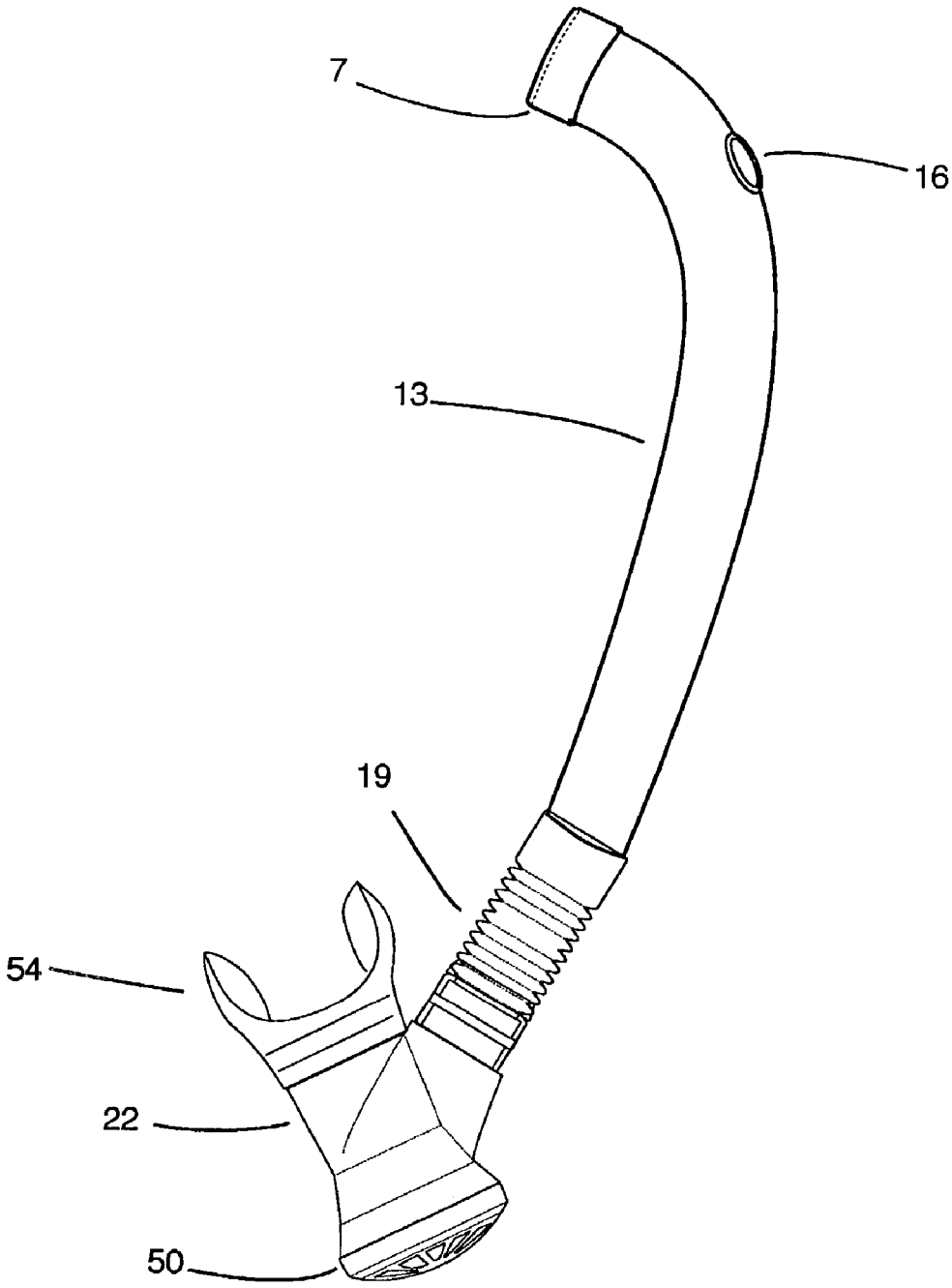
FIG. 1A is a front view of the assembled snorkel

To facilitate understanding of the flow through the snorkel, inhalation goes through an inhalation conduit 1 to the mouthpiece of the user, and exhalation goes from the mouthpiece to an exhalation conduit from which exhaled air exits the snorkel. The inhalation valve 3 includes all parts necessary to make a functioning valve; and the exhalation valve 4, which is a complex structure, refers to the valvular action of these parts as they functionally come together. The Purge Valve 5 is also shares structures of the Exhalation Valve 4 and is best thought of as a functional aspect of the snorkel that allows rapid purging. Although these items are best thought of in terms of their function, rather than graphically on paper, the individual components of these various structures are supplied in the drawings.

FIG. 1A shows the assembled snorkel in front view perspective. Several major structural elements are identified including the Inhalation Cap 7, the Main Tube 13, the Connecting Tube 19, the Mouthpiece 54, the Junction 22 which houses a Chamber 23 which communicates with the Inhalation Conduit 1, the Exhalation Conduit 48, and the Purge Reservoir 27. At the lower end of the snorkel is the Purge Cap 50. And near the upper end of the Main Tube 13 is the Exhalation Conduit Exit Port 16 where the exhaled air normally exits the snorkel.

Figure 1B:
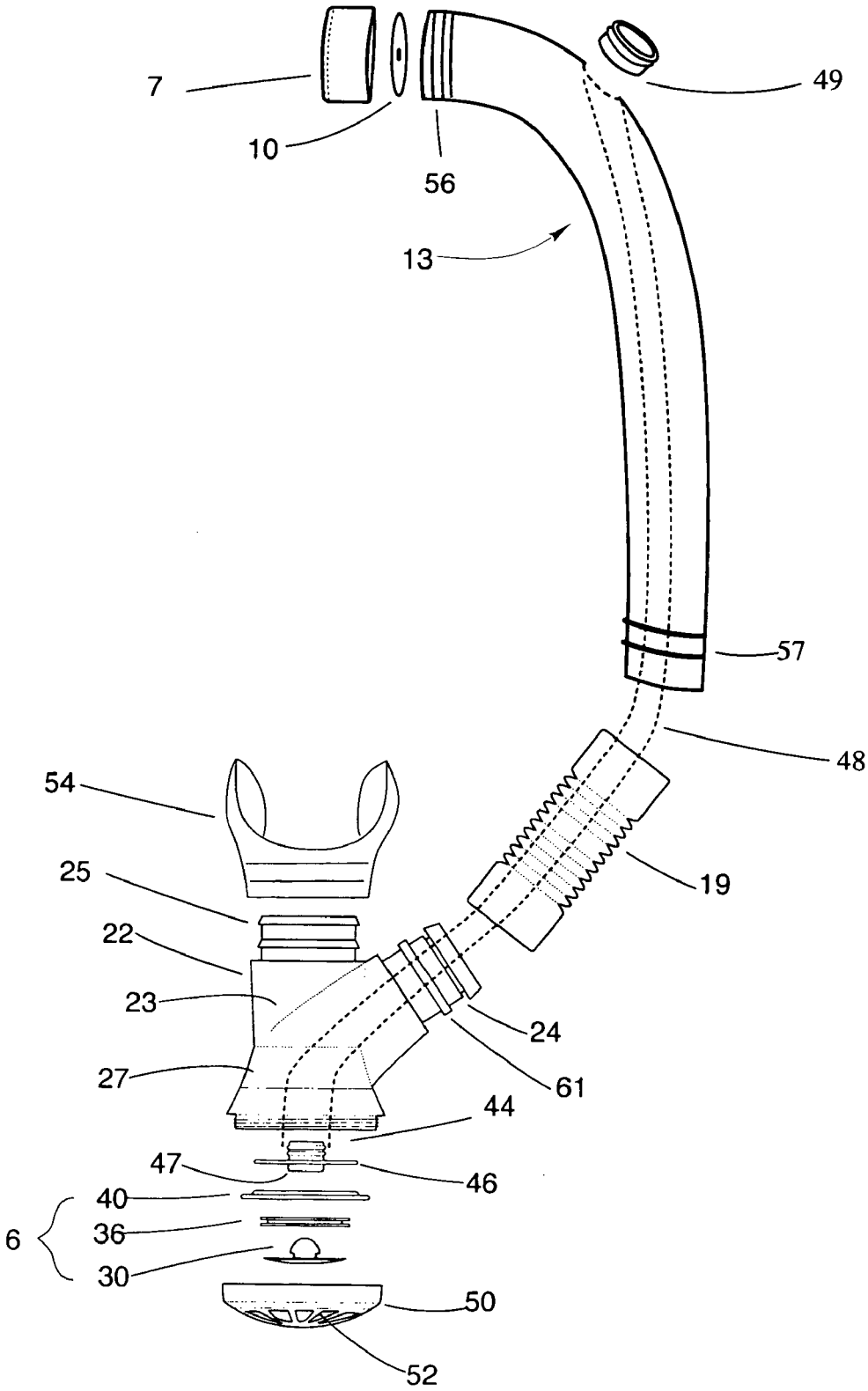
FIG. 1B is a front exploded view of the snorkel

FIG. 1B shows an exploded front view of the major structural components of the entire snorkel with the Inhalation Cap 7, the Inhalation Valve Diaphragm Member 10, the Main Tube 13, the Connecting Tube 19, and the Junction 22. The Combined Sealing Assembly 6 comprises the Combined Sealing Member 30, the Rigid Support Disk 36, and the Convoluted Membrane 40, which serves to flexibly mount the active components of the Exhalation Valve 4 which is a functional component of the Combined Sealing Assembly acting against the Sealing Ring 47 of the Exhalation Tube Lower Mount 44. The Exhalation Tube 48 mounts to the upper aspect of this structure as shown. The Exhalation Tube then courses up the central chambers of the snorkel until it mounts at its upper end by sandwiching between the Main Tube 13 and the hollow Exhalation Tube Mounting Plug 49. The Exhalation Tube Lower Mount 44 is connected to the Junction 22 by a Supporting Structure 46 which on a top down view resembles spokes extending out to an outer rim. Therefore, this Supporting Structure 46 does not impede fluid/air movement across it, e.g., from top to bottom. The Purge Cap 50 screws onto the Junction 22 and thereby secures the Combined Sealing Assembly 6 where its Convoluted Membrane 40 attaches between these two structures. Importantly, the Junction 22 houses the Chamber 23 where exhalation pressure is maintained by the combination of the Inhalation Valve 1 and the Exhalation Valve 2. The lower most portion of the Chamber 23 within the Junction 22 is referred to as the Purge Reservoir 27 as this is where splash/flood water would first accumulate.

Figure 2A:
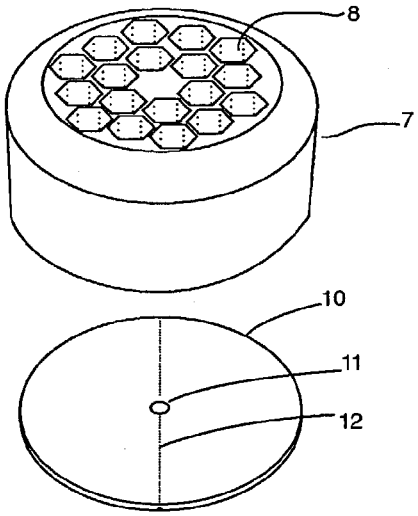
FIG. 2A is a top perspective view of the inhalation cap and the inhalation valve diaphragm member, which together form the inhalation valve.

FIG. 2A shows the Inhalation Cap 7, the Thru-Passages 8, and the Inhalation Valve Diaphragm Member 10, which taken together form the Inhalation Valve 3. The Inhalation Valve Diaphragm Member 10 has an optional partial thickness Groove 12 across its diameter and is centrally anchored at its Central Hole 11 by the Inhalation Valve Anchor 9 that is shown in FIG. 2B and FIG. 2C.

Figure 2B:
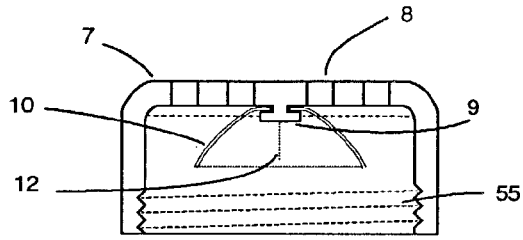
FIG. 2B is a transverse sectional view of the inhalation cap showing the inhalation valve in open position such as occurs during inhalation

FIG. 2B shows a transverse sectional view of the Inhalation Cap 7 and the deformed shape of the Inhalation Valve Diaphragm Member 10, representative of the valve in its open position as occurs during inhalation. All inhaled air passes through the Thru-Passages 8 of the Inhalation Cap 7 to enter the snorkel. Therefore the Inhalation Cap can be considered the first member of the Inhalation Conduit 1. The Inhalation Valve Diaphragm Member 10 is very flexible and easily deforms to minimize any contribution to airway resistance in the Inhalation Conduit 1. The optional partial thickness Groove 12 across its diameter allows this valve to function as a more efficient butterfly-style valve. Additionally, the Inhalation Cap 7 is sized such that the Thru-passages 8 combine in area to similarly minimize their contribution to airway resistance even at rapid inhalation flow rates. The Internal Threads 55 of the Inhalation Cap 7 are shown and mate with corresponding threads on the Main Tube 13 as described in FIG. 3A.

Figure 2C:
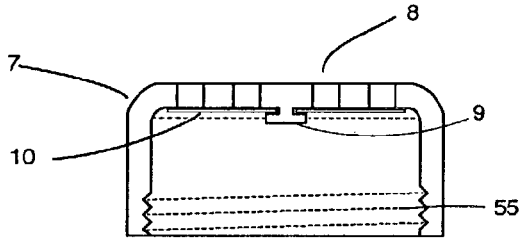
FIG. 2C is a transverse sectional view of the inhalation cap showing the inhalation valve in the closed position such as occurs during breath holding or exhalation

FIG. 2C is similar to FIG. 2B, but shows the Inhalation Valve Diaphragm Member 10 in its flattened shape as occurs while not inhaling. The Inhalation Valve Diaphragm Member 10 naturally, but gently, assumes this flat shape when no pressure gradient exists across the valve in order to minimize the closing sounds that would be experienced if the valve did not flatten until forcefully closed. Then, as exhalation occurs, the valve remains tightly closed as the pressure acting on the Exhalation Valve 4 (described in FIGS. 6A, 6B, and 6C) at the bottom of the snorkel propagates within the snorkel to provide the closing pressure for this Inhalation Valve 3. As long as the snorkel is generally oriented in the normal use position (i.e., with the Inhalation Valve 3 higher than the Exhalation Valve 4), and the user is not actively inhaling, this pressure will be adequate to prevent water from entering the snorkel via the Inhalation Cap 7.

Figure 3A:
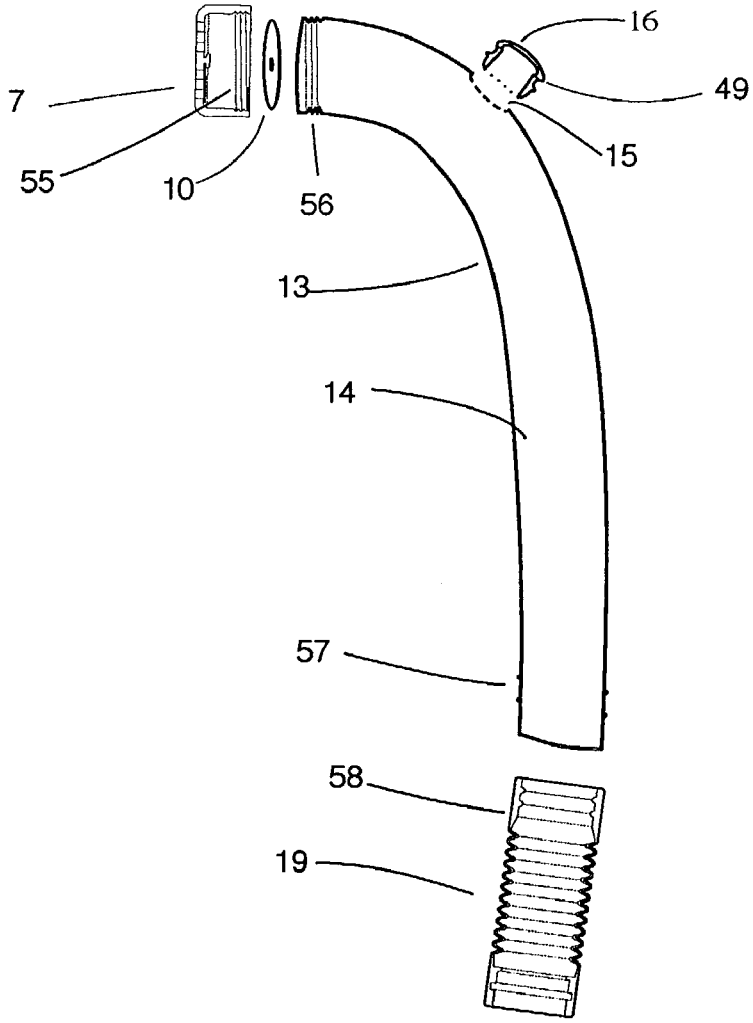
FIG. 3A is a transverse sectional view of the main tube and its associated structures

FIG. 3A shows a transverse sectional view of the Main Tube 13 and its related structures. The Inhalation Cap 7 mounts to the top end of the Main Tube 13 with a mating set of Internal Threads 55 and External Threads 56 on their respective components. The represented structures of the Inhalation Valve 3 are as described above for FIG. 2B and FIG. 2C. The Main Tube's Central Channel 14 directly receives inhaled air from the Inhalation Valve 3 and therefore becomes the second functional member of the Inhalation Conduit 1, wherein the Inhalation Conduit 1 is defined to be the network of tubes and other hollow structures through which inhaled air sequentially passes. The Exhalation Tube Upper Mount 15 is integral with the Main Tube 13 and provides a circular outer wall against which the upper end of the Exhalation Tube 48 is sandwiched by the hollow Exhalation Tube Mounting Plug 49. This design effectively eliminates a potential air leak between the Exhalation Conduit 48 and the Inhalation Conduit 1 of the snorkel that could otherwise be problematic as the Exhalation Conduit 48 passes through this wall of the Inhalation Conduit 1. The Exhalation Conduit Exit Port 16 is an opening in the Inhalation Conduit 1 through which the Exhalation Conduit 48 exits the snorkel. The Main Tube 13 has an Ellipsoid Cross-Section 17 at its lower end to reduce hydrodynamic drag while swimming and it transitions to a Circular Cross-Section 18 at its upper end to allow the Inhalation Cap 7 to screw-mount. The lower end of the Main Tube 13 mounts to the flexible Connecting Tube 19 with the Ribs on Main Tube 57 mating with the Grooves in Connecting Tube 58.

Figure 3B:
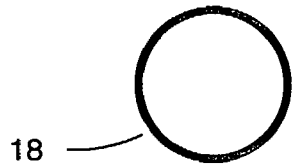
FIG. 3B shows the transverse sectional view of FIG. 3A with the exhalation tube coursing within the main tube and mounting to the main tube's exhalation tube upper mount

FIG. 3B shows the Circular Cross-Section 18 of the upper end of the Main Tube 13.

Figure 3C:
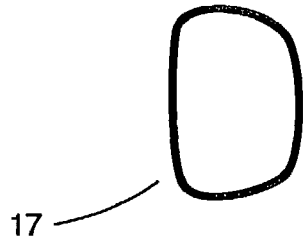

FIG. 3C shows the Ellipsoid Cross-Section [17] of the lower end of the Main Tube [13].

Figure 3D:
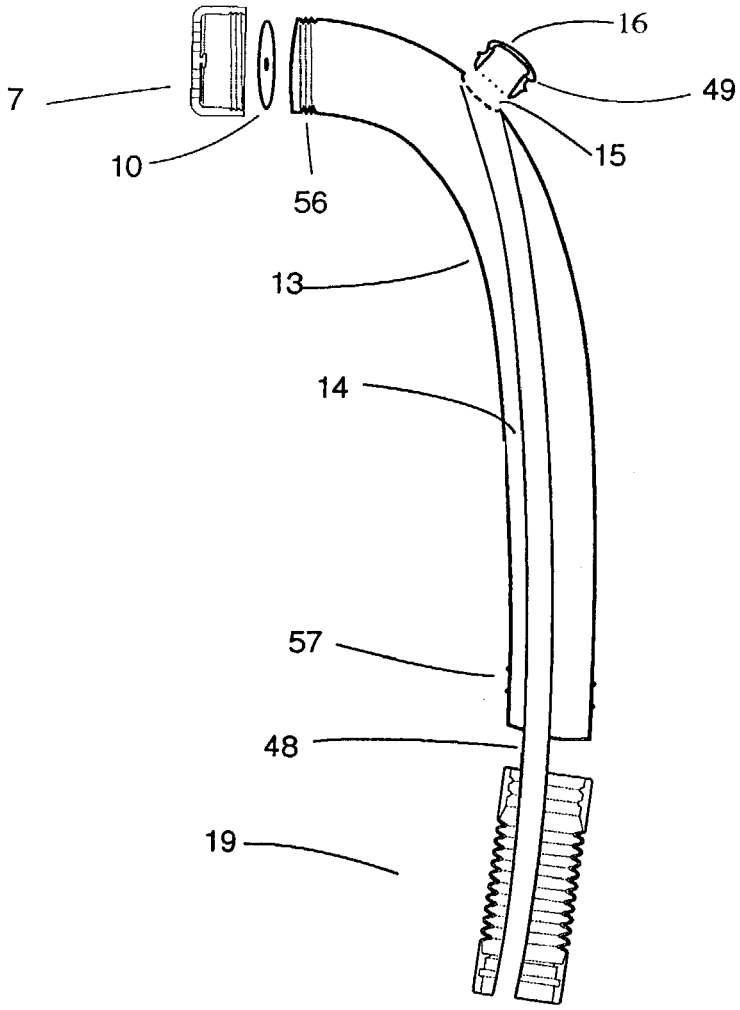
Figure 3B:
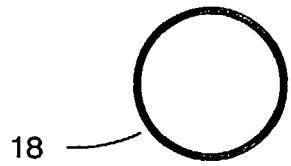
Figure 3C:
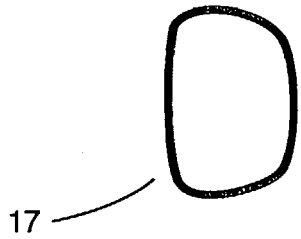

FIG. 3D is identical to FIG. 3A except that it also shows the Exhalation Tube 48 as it courses through the Main Tube 13.

Figure 4A:
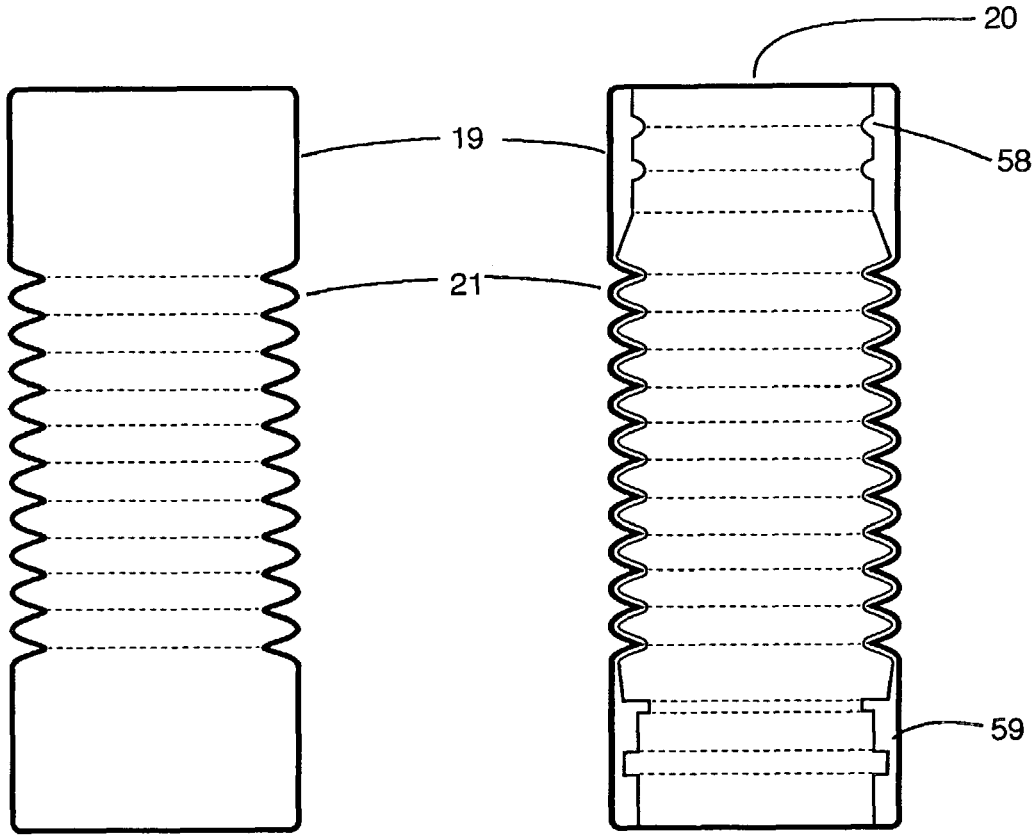
FIG. 4A is a side view of the ribbed flexible connecting tube

FIG. 4A is a side view of the ribbed flexible Connecting Tube 19. The Outer Ribs 21 provide radial support for the tube, while still allowing it to be flexible and bend. This bending provides improved comfort while the snorkel is being worn, particularly if other diving gear is also concurrently being used.

FIG. 4B is a transverse sectional view of the ribbed flexible Connecting Tube 19 that is also described in FIG. 4A. Now shown is the Central Channel 20 of this tube, which is the third functional member of the Inhalation Conduit 1. Further revealed herein are the Upper Grooves 58 of the Connecting Tube 19 that mate with corresponding Ribs 57 on the Main Tube 13 (shown in FIG. 3A) and the Lower Grooves 59 of the Connecting Tube 19 that mate with Ribs 60 on the Junction 22 (shown in FIG. 5A)

Figure 5A:
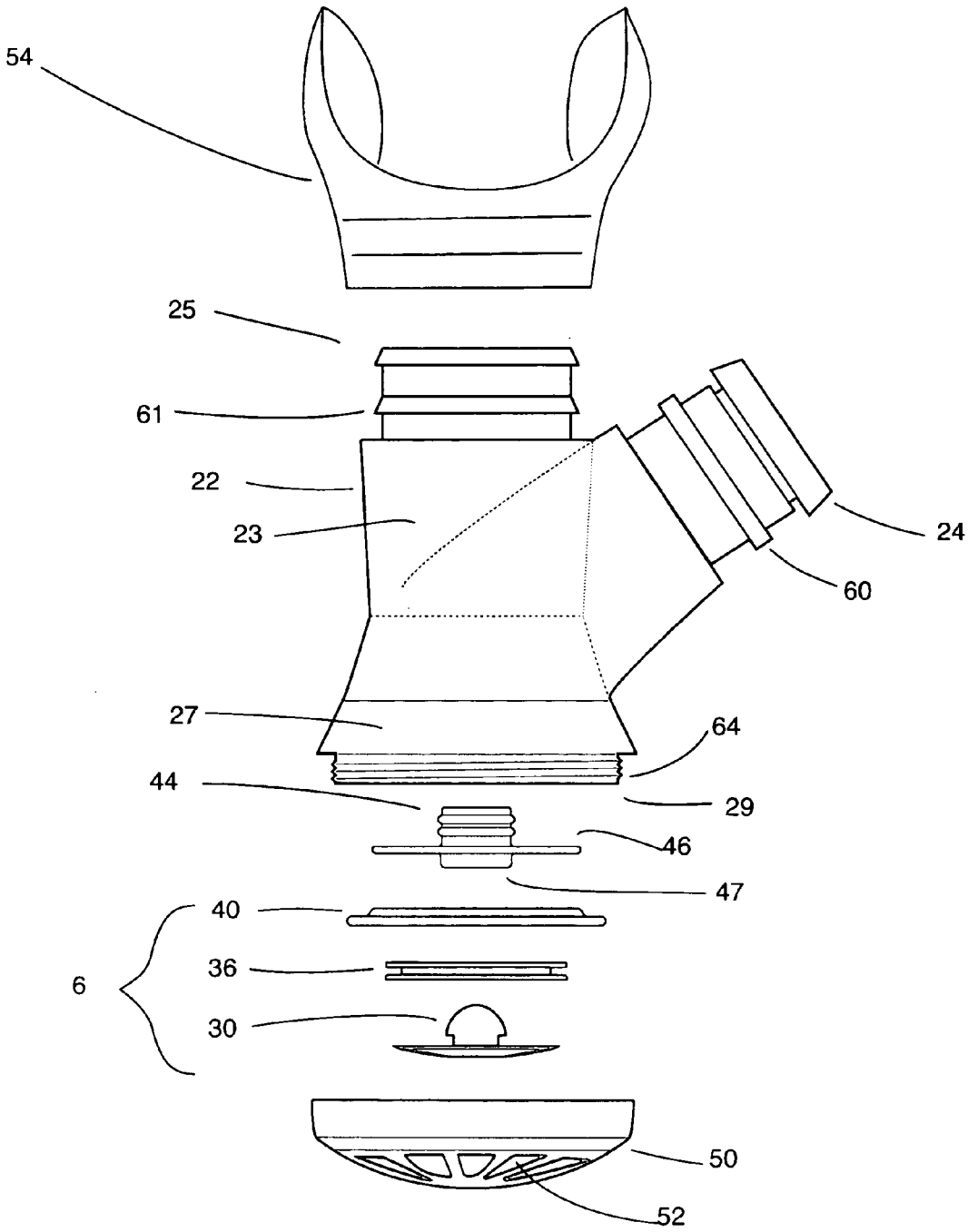
FIG. 5A is an exploded side view of the junction with the mouthpiece, the exploded exhalation valve/purge valve assembly, and the purge cap.

FIG. 5A is an exploded side view of the Junction 22 and its related structures:

Three mounts are integral to the Junction 22 including the Connecting Tube Mount 24 with its attachment Ribs 60, the Mouthpiece Mount 25 with its attachment Ribs 61, and the Purge Cap Mount 29 with its External Threads 64.

The Junction 22 houses a small volume Chamber 23, which receives inhaled air from the Central Channel 20 of the Connecting Tube 19 (shown in FIG. 4B), thereby becoming the fourth functional member of the Inhalation Conduit 1. In other embodiments, the chamber might not be a functional member of the inhalation conduit. This Chamber 23 receives exhaled air from the Mouthpiece 54. This Chamber 23 is pressurized during exhalation and functionally provides the counter pressure to the user's airways. The lower region of the Chamber 23 is more specifically referred to as the Purge Reservoir 27, as any captured water accumulates here first.

Importantly, the Junction 22 also houses the functional Exhalation Valve 4 and Purge Valve 5. In the preferred embodiment, these two valves share three structural elements which, taken together, are simply referred to as the Combined Sealing Assembly 6. The structures of this assembly are depicted for the preferred embodiment in FIGS. 6A through 6C, while examples of alternative embodiments of the Exhalation Valve 4 and the Purge Valve 5 are shown separately in FIGS. 7 and 8.

Figure 6A:
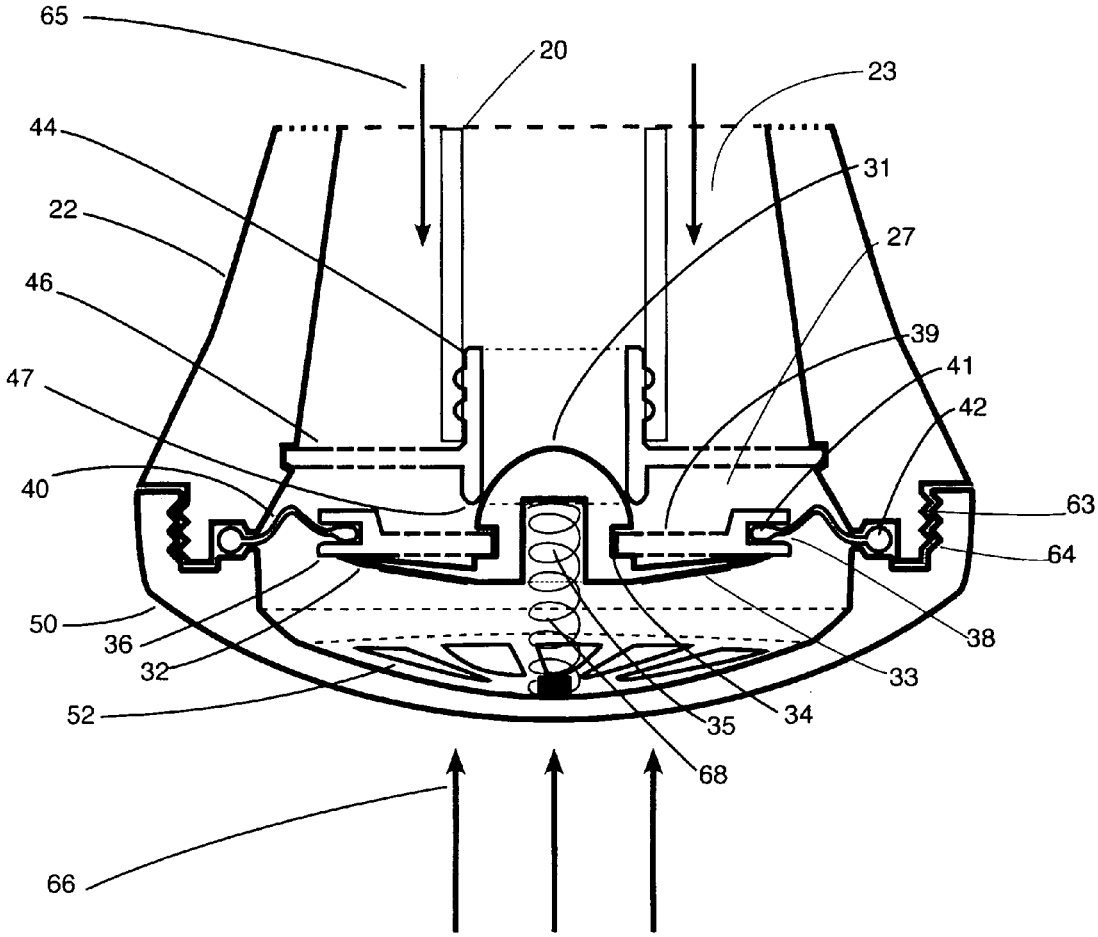
FIG. 6A is a transverse sectional view of the junction with the exhalation valve in closed position.
Figure 6B:
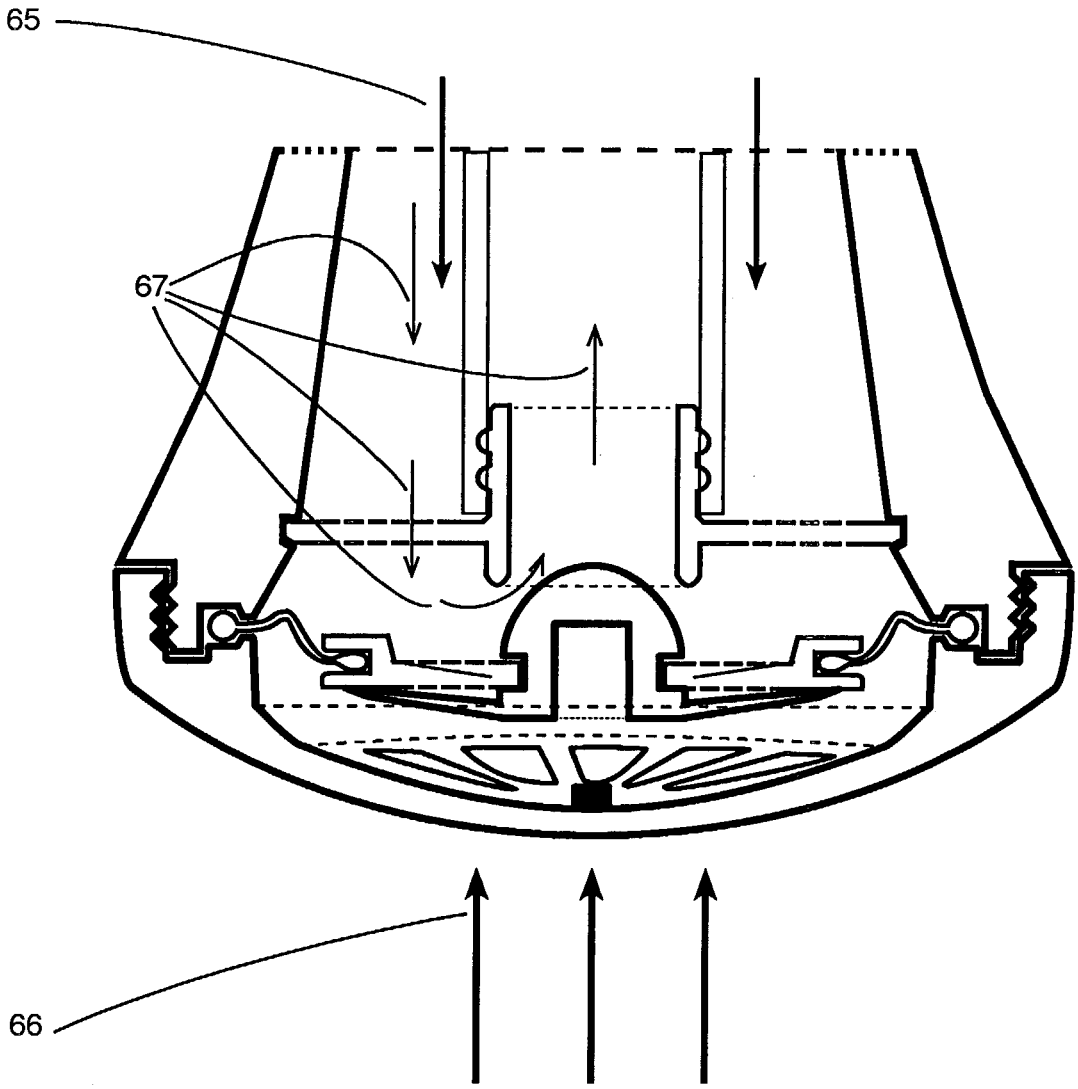
FIG. 6B is a transverse sectional view of the junction with the exhalation valve in open position as occurs in normal exhalation
Figure 6C:
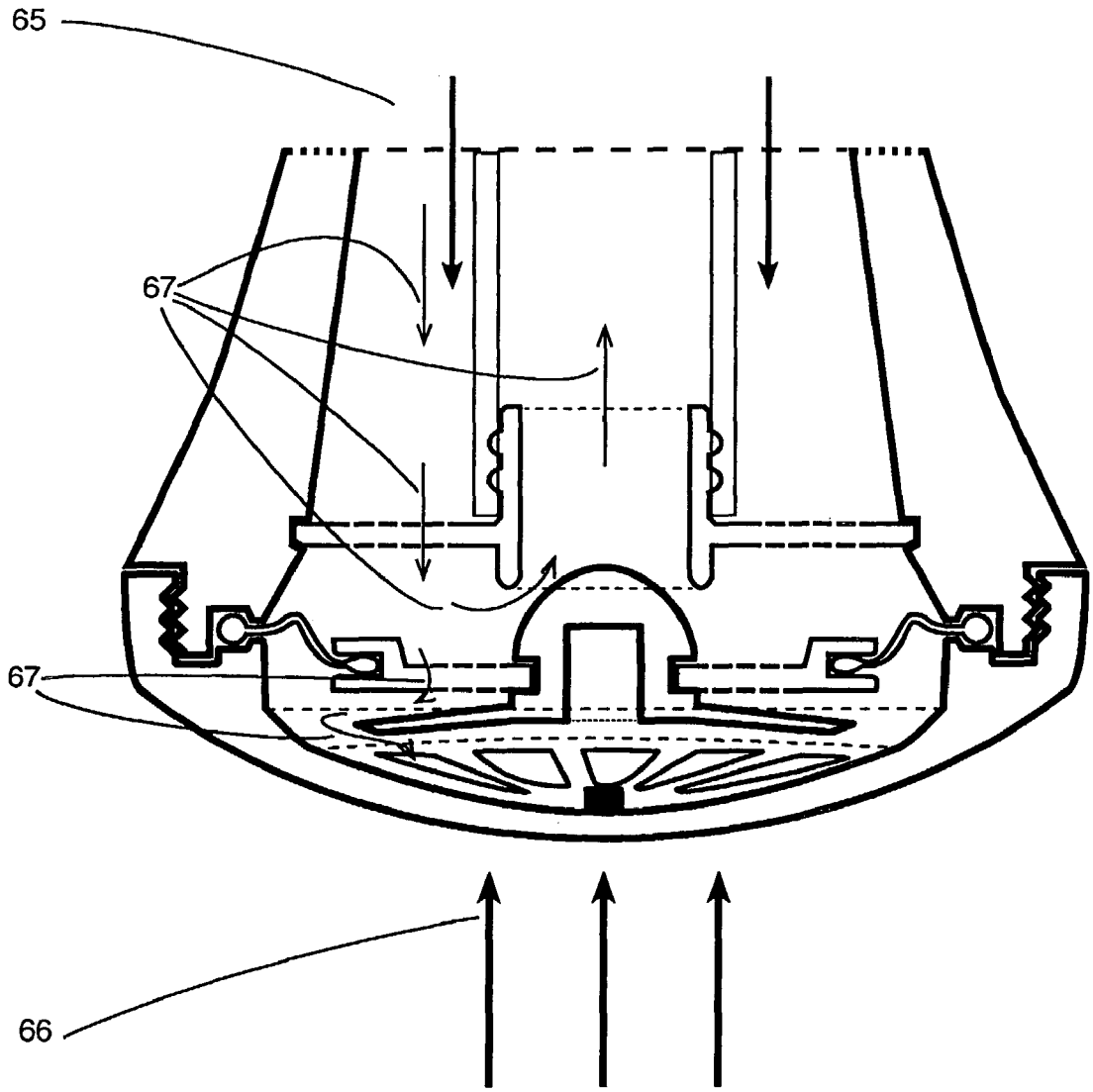
FIG. 6C is a sectional view of the junction with the rapid purge ports open as occurs during purging levels of exhalation

The Exhalation Tube Lower Mount 44 is statically attached, via its spoke and rim-like Supporting Structure 46, to the Junction 22 at said junction's Snap Mount for Exhalation Tube Lower Mount 26 (which is shown in FIGS. 6A, 6B, and 6C). The Exhalation Tube Lower Mount 44 additionally provides the Sealing Ring 47 for the Exhalation Valve 4. Inasmuch as this Exhalation Tube Lower Mount 44 directs exhaled air from the Chamber 23 to the Exhalation Tube 48 (also referred to as exhalation conduit 48).

The Exhalation Valve 4 is comprised of elements of the Combined Sealing Assembly 6 and the Sealing Ring 47, which items are described in more detail in FIGS. 6A, 6B, and 6C.

FIG. 5A also shows the Purge Cap 50 which screws onto the Junction 22 at the corresponding mount. The Pure Cap 50 also is shown with the Purge Cap Perforations 52 which allow water pressure to act on the Exhalation Valve 4 and provides an exit for water that is purged across the Purge Valve 5.

FIG. 5B is an exploded perspective view of the Combined Sealing Assembly 6. This assembly comprises the silicon rubber Combined Sealing Member 30, the Rigid Support Disk 36, and the flexible Convoluted Membrane 40.

The Combined Sealing Member 30, which is a one-part structure, provides the Exhalation Valve Sealing Member 31 and the Purge Valve Sealing Member 32. In the preferred embodiment, the Exhalation Valve Sealing Member 31 is dome-shaped in order to very gradually open exit flow and reduce vibration as exhaled air escapes across the Exhalation Valve 4 when just minimally open. Other shapes that could similarly result in dampening include teardrop or cone. The contiguous Purge Valve Sealing Member 32 notably has Dampening Ribs 33 that project out radially in various lengths from the underside of the Purge Valve Sealing Member 32 and serve to reduce or eliminate the buzz that would otherwise occur while purging. The Combined Sealing Member 30 also has an Attachment Groove 34 around its midsection that provides secure attachment to the Rigid Support Disk 36. The Hollow Region 35 allows the Combined Sealing Member 30 to be compressed for assembly purposes, and provides a recess mount for an optional Spring 68 (FIG. 6A) that could further refine the exhalation Airway Pressure 65 if modification is desired in the future.

The Rigid Support Disk 36 provides several functions: It supports the Combined Sealing Member 30 that allows the Exhalation Valve Sealing Member 31 to form a stable seal with the Sealing Ring 47 (shown in FIG. 6A, FIG. 6B, and FIG. 6C); it provides a broad surface against which the Ambient Water Pressure 66 (depicted in FIG. 6A, FIG. 6B, and FIG. 6C) acts to balance the desired exhalation Airway Pressure 65 (depicted in FIG. 6A, FIG. 6B, and FIG. 6C) within the snorkel; it supports the Purge Valve Sealing Member 32 to maintain proximity with the sealing surface of same disk; and it provides a smooth, rigid surface against which the Purge Valve Sealing Member 32 can seal. The Rapid Purge Channels 39 in the Rigid Support Disk 36 are closed by the Purge Valve Sealing Member 32, except during active purging operations when Airway Pressure 65 reaches a sufficient threshold for them to open for very rapid purge, taking full advantage of the higher exhalation Airway Pressures 65 which are maintained within the snorkel. The Central Hole 37 in the Rigid Support Disk 36 supports the Combined Sealing Member 30 at said member's Attachment Groove 34. The Outer Groove 38 of the Rigid Support Disk 36 provides mounting attachment to the Central Anchor 41 of the flexible Convoluted Membrane 40.

The Convoluted Membrane 40 is a flexible, annular structure that has transverse sectional convolutions to allow axial travel of the Rigid Support Disk 36 and the Combined Sealing Member 30. This functionally allows the Exhalation Valve Sealing Member 31 to appropriately open and close its seal against the Sealing Ring 47 (shown in FIG. 6A, FIG. 6B, and FIG. 6C), thereby utilizing the Ambient Water Pressure 66 to modulate the user's immersed and submersed exhalation rates. The Convoluted Membrane 40 has a Central Anchor 41 for secure attachment to the Rigid Support Disk 36 and a Peripheral Anchor 42 for secure mounting in the space defined by the Convoluted Membrane Junction Groove 28 (of the Junction 22 described separately in FIG. 6A) and the corresponding Convoluted Membrane Purge Cap Groove 51 (of the Purge Cap 50 described separately in FIG. 6A). The screw mount of the Purge Cap 50 onto the Junction 22 slightly compresses this Peripheral Anchor 42, which beneficially creates a seal to prevent water from entering the snorkel, and helps to lock the threads of the Purge Cap Mount 29.

FIG. 5C is a transverse sectional view of the parts shown in FIG. 5B.

FIG. 5D is top view of the Combined Sealing Assembly 6 as comprised by the parts of FIG. 5B.

FIG. 5E is a transverse sectional view of the Combined Sealing Assembly 6 as comprised by the parts of FIG. 5C.

FIG. 6A is a transverse sectional view of the Junction 22 with the Exhalation Valve 4 in closed position. Numerous items identified in this figure are described in detail in FIG. 5A and FIG. 5B. Of note, the User's Airway Pressure 65, which acts on the Combined Sealing Assembly 6 from above, is inadequate to overcome the inward compressing force that the Ambient Water Pressure 66 produces from below. Therefore, the Exhalation Valve Sealing Member 31 assumes tight closure against the Sealing Ring 47 and exhalation flow is prevented. The Convoluted Membrane 40 assumes a transverse sectional shape that is compatible with the Rigid Support Disk 36 being at its upper end of axial travel. Also shown is an the optional mechanical Spring 68 which could be used to further refine the counter pressure upon exhalation that is achieved.

FIG. 6B is a transverse sectional view of the Junction 22 with the Exhalation Valve 4 in open position. This figure is very similar to that of FIG. 5C, except that FIG. 5D depicts the condition of normal exhalation in which the user's Airway Pressure 65 exceeds Ambient Water Pressure 66, thereby exerting a net downward force on the Combined Sealing Assembly 6, removing the Exhalation Valve Sealing Member 31 from its sealing position against the Sealing Ring 47. Flow Arrows 67 depict the direction of airflow through the Chamber 23, across the Exhalation Valve 4, and into the Exhalation Tube 48, from whence it is channeled to exit the snorkel. The Convoluted Membrane 40 assumes a transverse sectional shape that is compatible with the Rigid Support Disk 36 being near its lower end of axial travel.

FIG. 6C is a transverse sectional view of the Junction 22 with the Purge Valve 5 in open position. Note that the Exhalation Valve 4 is also in open position, because the Airway Pressure 65 required for purging is excessive for normal exhalation. As per FIG. 6A and FIG. 6B, the description of many items shown in this figure is deferred to their descriptions in FIG. 5A and FIG. 5B. Note that the Purge Valve Sealing Member 32 is separated from the Rigid Support Disk 36, thereby allowing the contents of the snorkel to be expelled through the Rapid Purge Channels 39. The Purge Valve Sealing Member 32 has a bias for closure molded into its shape such that the Airway Pressure 65 must be distinctly greater than the Ambient Water Pressure 66 in order for the Purge Valve Sealing Member 32 to become displaced form the Rigid Support Disk 36. The Convoluted Membrane 40 assumes a transverse sectional shape that is compatible with the Rigid Support Disk 36 being at its lowest end of travel.

Figure 7A:
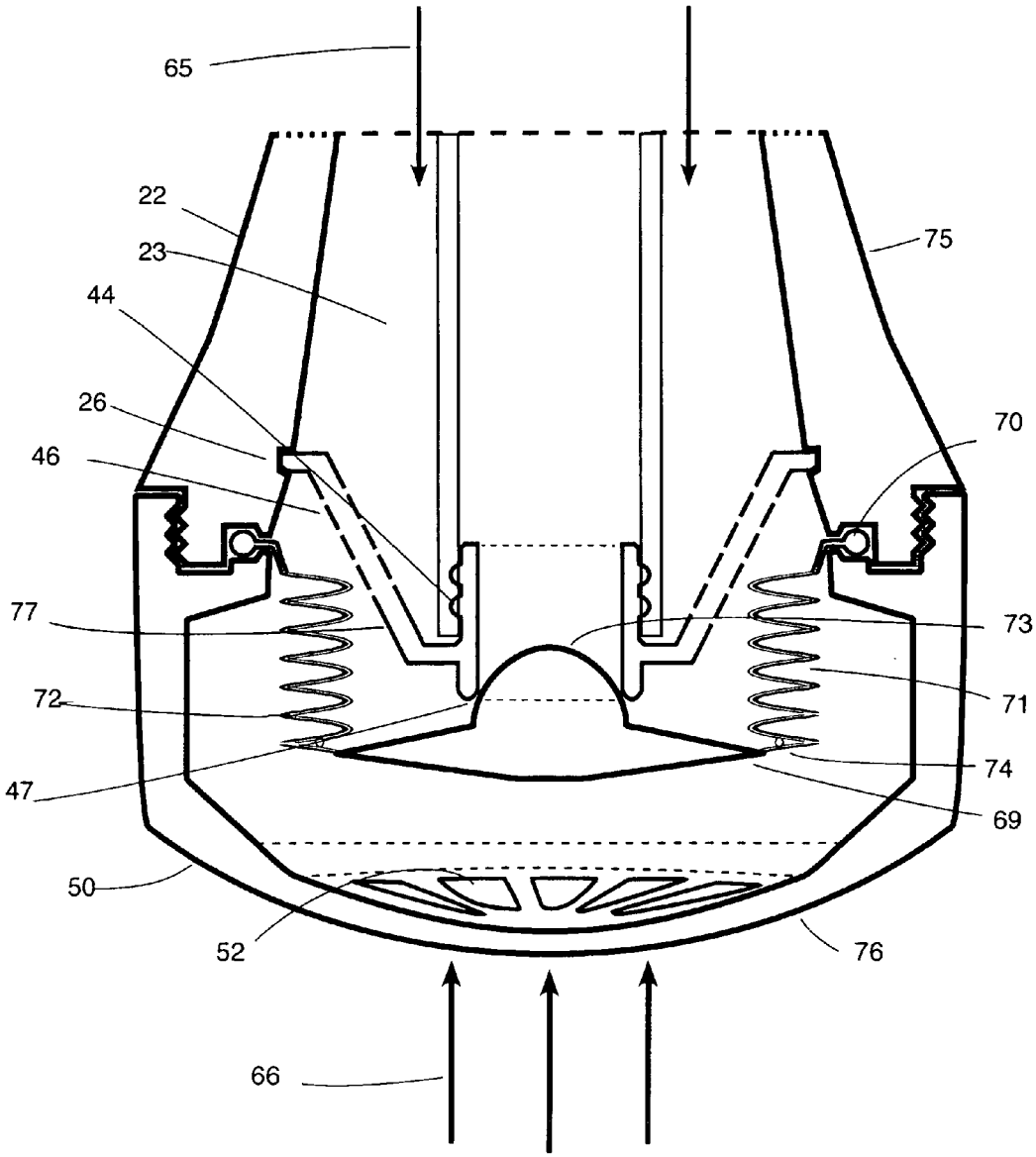
FIG. 7A is a sectional view of an alternative exhalation valve/purge valve apparatus showing a compressible accordion-style wall. This wall has slits in the lower, outer accordion walls that are closed, unless the walls are fully distended as in a purge operation.

FIG. 7A is a sectional view of an alternative embodiment of the snorkel that replaces the three parts of the Combined Sealing Assembly 6 with one single molded flexible rubber part, the Flexible Sealing Member 69. In doing so, the Junction 75, the Purge Cap 76, and the Exhalation Tube Lower Mount 77 are all modified for this alternative embodiment. This Flexible Sealing Member 69 has a Sealing Member Anchor 70 along it circumference that secures this member to the Juntion 75 and the Purge Cap 76 in similar fashion to the Peripheral Anchor 42 previously described for the preferred embodiment. The Flexible Sealing Member 69 also has a Sealing Dome 73 component that provides the functionality of the Exhalation Valve Sealing Member 31 previously described for the preferred embodiment. The Rigid Support Disk 36 of the preferred embodiment has been eliminated. An optinal Rigid Ring 74 may be placed within the deeper folds of the Accordion Wall 71 for additional mechanical support. Purge operations are facilitated by a series of small Purge Slits 72 in the outer folds of Accordion Wall 71 which remain closed due to the molded shape of the wall and the compressive forces of ambient water, until the Airway Pressure 65 is adequate to fully distend the Accordion Wall 71, thereby opening these Purge Slits 72 in a fashion similar to duck bill valves.

Figure 7B:
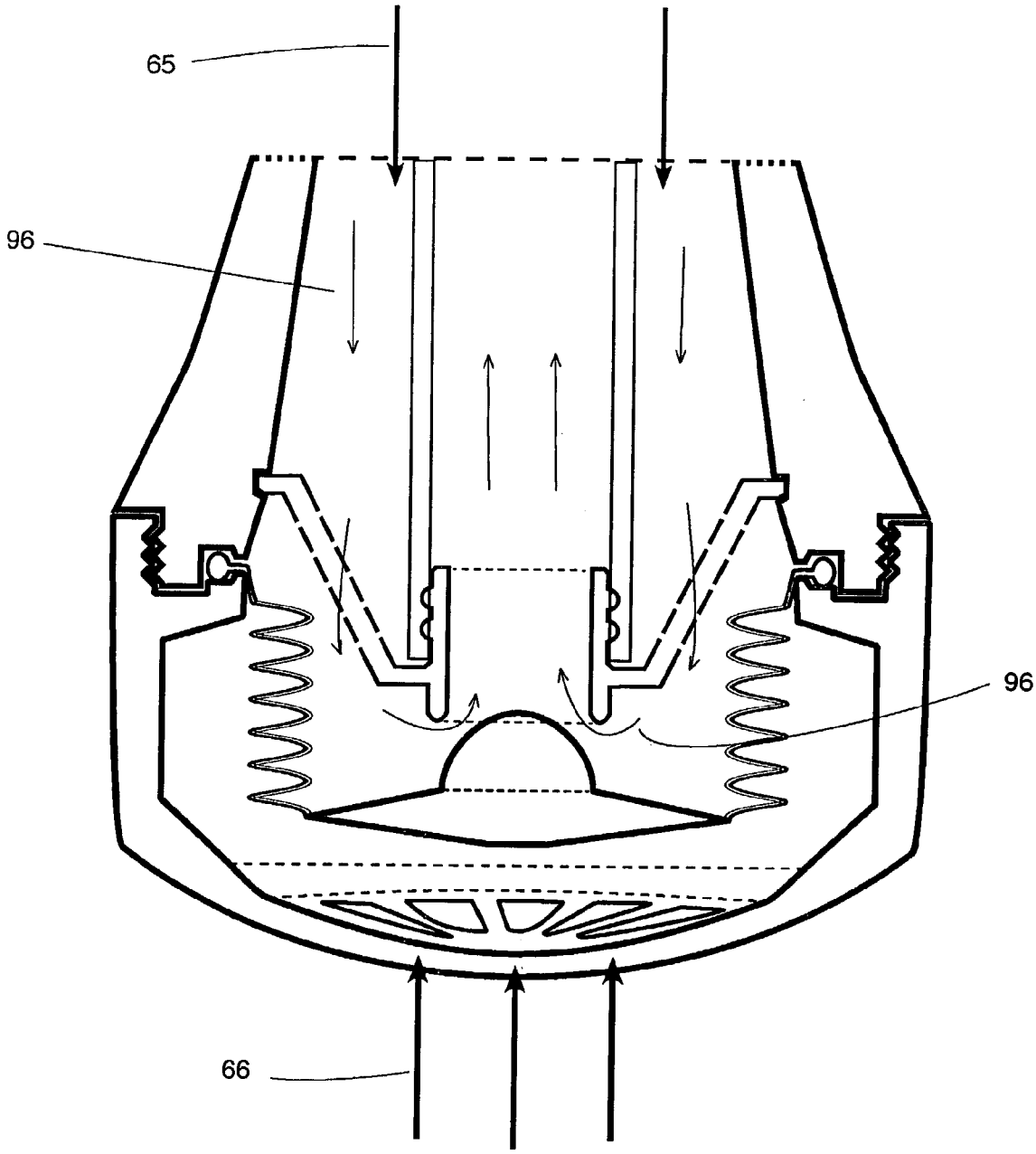
FIG. 7B is a sectional view similar to FIG. 7A showing the exhalation valve in open position with the purge valve in the closed position.

FIG. 7B is the alternative embodiment of FIG. 7A in a condition of normal exhalation as is the condition of the preferred embodiment in FIG. 6B, in which the Airway Pressure 65 is adequate for exhalation, but inadequate for rapid purge operation. The Sealing Dome 73 has separated from the Exhalation Tube Sealing Ring 47 allowing exhaled air to exit the snorkel as shown by the Flow Arrows 75

Figure 7C:
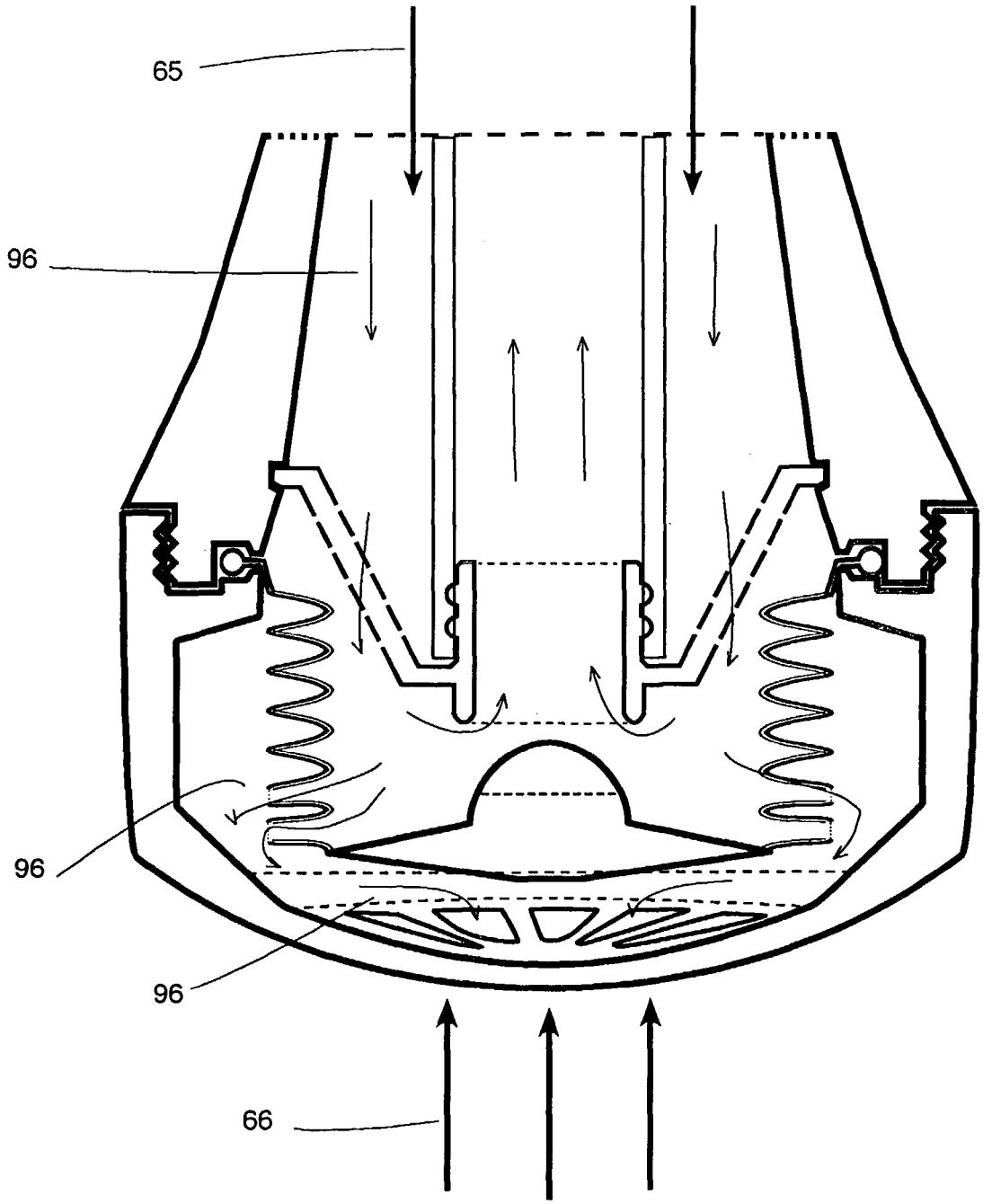
FIG. 7C is a sectional view similar to FIG. 7A showing both the exhalation valve and the purge valve open.

FIG. 7C is the alternative embodiment of FIG. 7A in a condition of purge operation as is the condition of the preferred embodiment in FIG. 6C, in which the Airway Pressure 65 is exceeds the threshold pressure for purging. Purge Slits 72 are now evident in the lower, outer silicon rubber (or otherwise flexible) Accordion Wall 71. These Purge Slits 72 open with sufficient pressure to provide excellent purge capability, but otherwise generally remain closed for normal exhalation activities.

Figure 8:
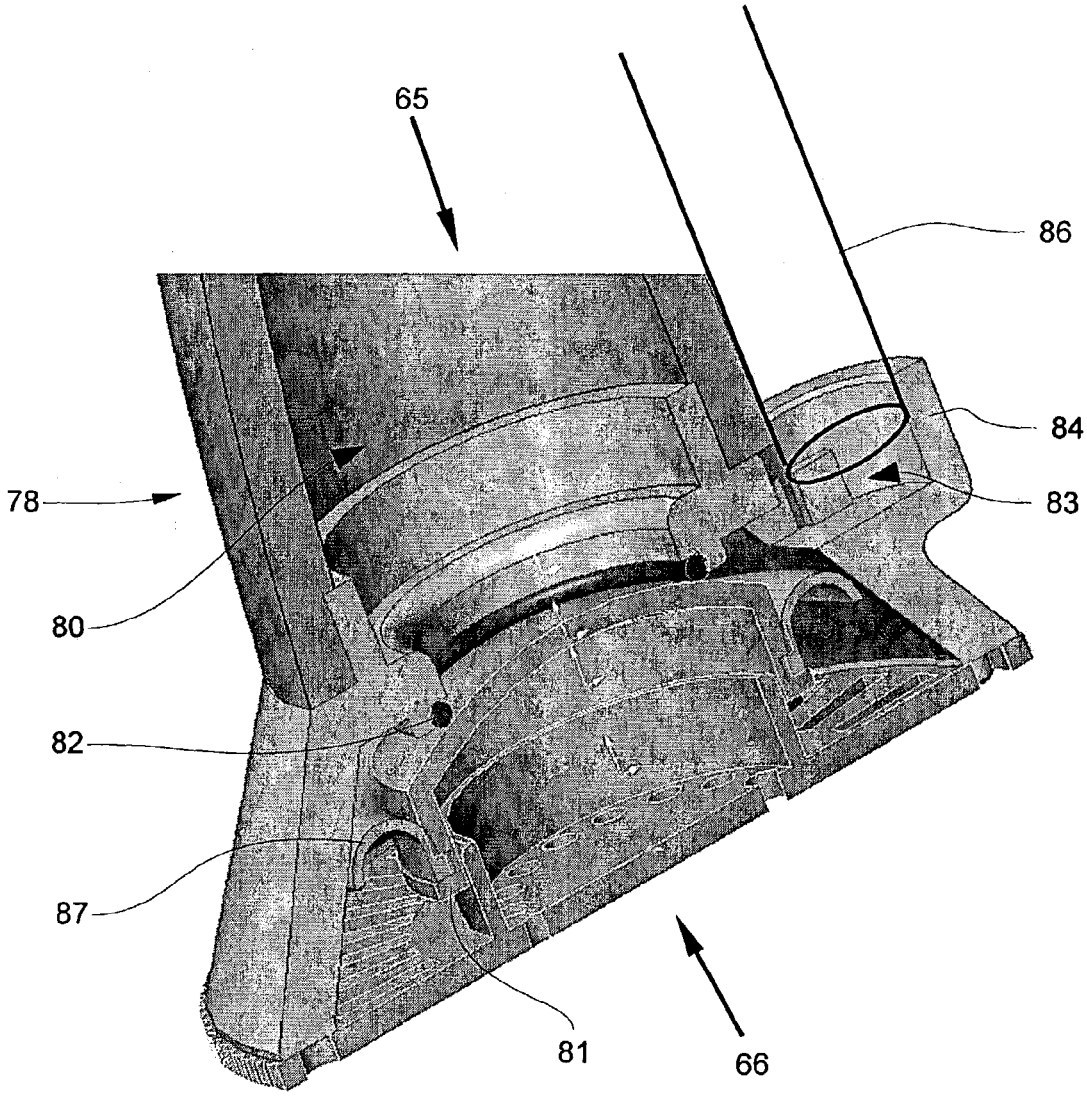
FIG. 8 is another cross-sectional view of an alternative exhalation valve/purge valve apparatus showing a dome that travels vertically and an externally positioned exhalation tube.
Figure 9:
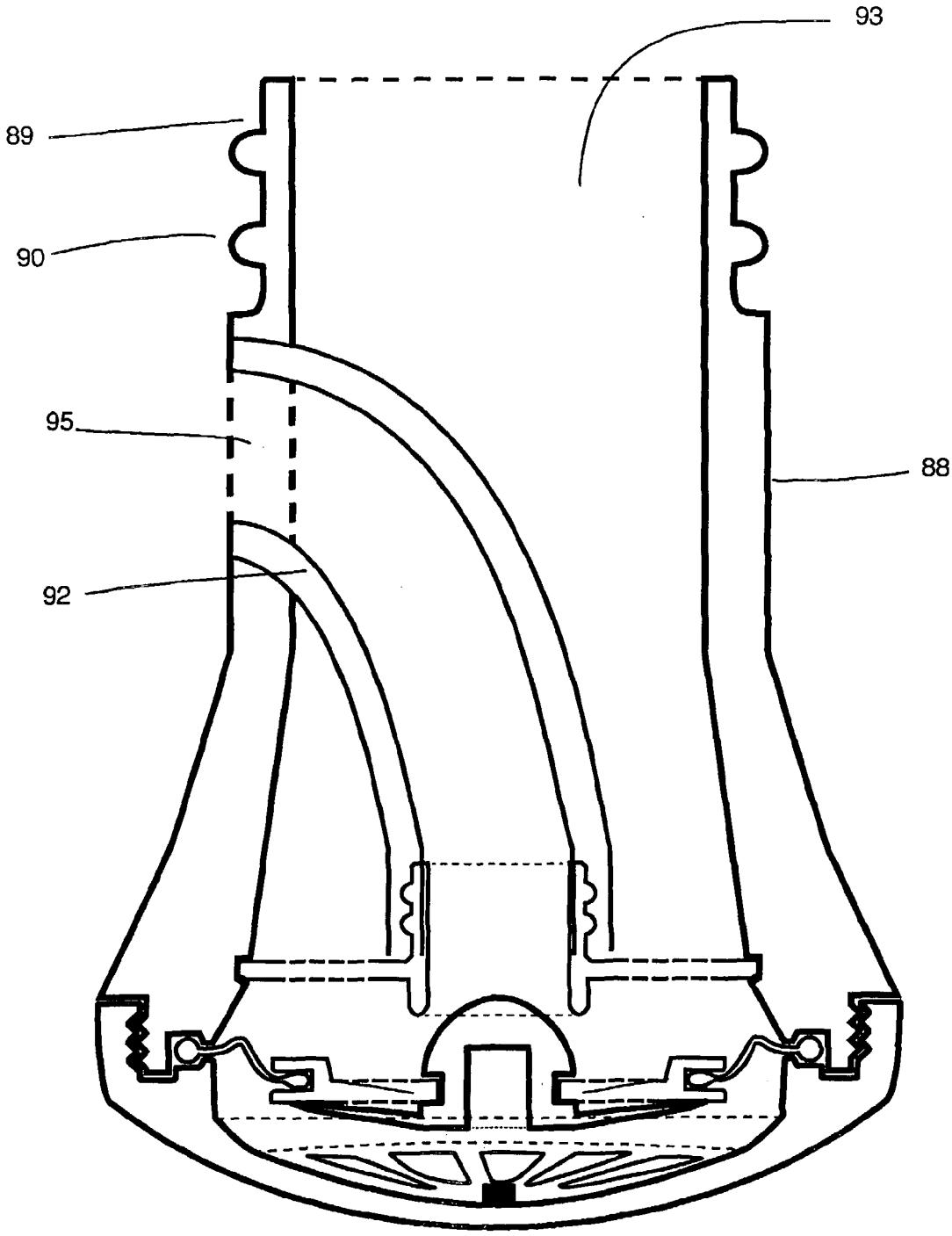
FIG. 9 is a transverse sectional view of the junction which houses the exhalation valve, as it is adapted to mount to a connecting tube, which in turn mounts to the exhalation vents or equivalent of a scuba regulator.

FIG. 8 reveals another embodiment of the snorkel that now features a significantly modified design of the Junction 78 that similarly contains a Chamber 80 for counter pressure, but has an Exhalation Exit Port 83 near the bottom of the snorkel, an External Exhalation Tube Mount 84, and an External Exhalation Tube. The moving element which provides counter pressure for our desired PEEP is the Sealing Cup 80 which travels coaxially and is supported laterally by the a Sealing Cup Rigid Support 81. As the forces of Airway Pressure 65 in the Chamber overcome the forces of Ambient Water Pressure 66, the Sealing Cup 81 separates from the O-Ring Seal 82, allowing air to escape into the space above the perimeter of the Sealing Cup 81, which is then vented to the External Exhalation Tube 86 via the External Exhalation Tube Mount 85. A Sliding Seal 87 helps maintain dryness within the snorkel and deflects downward with the greater FIG. 8 is another cross sectional pressures accomplished during purge operations FIG. 9 is a transverse sectional view of the enclosing structures of the Exhalation Valve [4] as is modified to attach, via a non-collapsible air tube, to the exhalation vent on a typical scuba regulator. This invention, in effect, becomes an "exhalation regulator" for scuba diving purposes, as it functions to regulate the exhalation rate of the scuba diver. The device may be worn at mouth or chest level, depending on the comfort of the user. The Junction 88 has been shortened from the preferred embodiment (described in FIGS. 5A thru 5D and FIGS. 6A thru 6C) for this alternative embodiment as it may be adapted for scuba or snuba purposes. Furthermore, the Mouthpiece Mount 25 of the preferred snorkel embodiment has been eliminated as this is not necessary for scuba The exhalation vent from the separate scuba regulator attaches via a Connecting Tube 94 to the Ribbed 90 Connecting Tube Mount 89. The Exhalation Tube 92 has been significantly shortened and the Exhalation Conduit Exit Port 95 has been moved to the Junction 88. The Chamber 93 importantly continues to serve as a counter pressure chamber to accomplish the improved exhalation pressures as described herein.

FIG. 9 is transverse sectional view of the Exhalation Valve 4 and related structures as described in FIG. 6B and as adapted to mount to the exhalation vent on a scuba regulator or snuba equipment. Note that the Exhalation Tube 48 is significantly shortened and exits from the Junction 22 through a sidewall in the Junction 22].

While the present inventions have been described and illustrated in conjunction with a number of specific embodiments, those skilled in the art will appreciate that variations and modifications may be made without departing from the principles of the inventions as herein illustrated, described and claimed.

The present inventions may be embodied in other specific forms without departing from their spirit or characteristics. The described embodiments are to be considered in all respects as only illustrative, and not restrictive. The scope of the inventions is, therefore, indicated by the appended claims, rather than the foregoing descriptions. All changes and variations that come within the meaning and range of equivalency of the claims and their elements or limitations are to be embraced within their scope.

What is claimed is:

1. A snorkel comprising:

an inhalation conduit adapted to receive inhaled air;

a chamber adapted to receive exhaled air;

a sealing member adapted to release the exhaled air from the chamber when an exhalation pressure in the chamber exceeds a counter pressure and adapted to retain the exhaled air in the chamber when the exhalation pressure does not exceed the counter pressure, the counter pressure comprising an ambient water pressure when at least a portion of the snorkel is submerged in water; and an exhalation conduit separate and distinct from the inhalation conduit, the exhalation conduit being sized and configured to receive the exhaled air that is released from the chamber, the exhalation conduit being sized and configured to allow the passage of exhaled air out of the snorkel;

wherein the sealing member further comprises a valve adapted to control the release of exhaled air from the chamber into the exhalation conduit in response to a difference in pressure between the exhalation pressure and the counter pressure;

wherein the valve is adapted to allow the exhaled air to enter the exhalation conduit when the exhalation pressure exceeds the counter pressure; and wherein the valve is adapted to substantially prevent the exhaled air from entering the exhalation conduit when the exhalation pressure does not exceed the counter pressure.

2. The snorkel as in claim 1, wherein the sealing member is at least partially supported by a support structure.

3. The snorkel as in claim 1, further comprising a pressure member against which the counter pressure acts to provide the counter pressure to the exhalation pressure in the chamber.

4. The snorkel as in claim 3, wherein the pressure member is movable in response to a pressure difference between the exhalation pressure and the counter pressure; and wherein the sealing member is movable in response to movement of the pressure member.

5. The snorkel as in claim 3, wherein the pressure member comprises a rigid support disk and a flexible support membrane.

6. The snorkel as in claim 1, further comprising an exit port adapted to allow exhaled air to exit from the exhalation conduit.

7. The snorkel as in claim 1, further comprising an exhalation valve adapted to exert at least a portion of the counter pressure against the exhalation pressure and to regulate entry of exhaled air into the exhalation conduit.

8. The snorkel as in claim 1, further comprising a purge valve for purging water from the snorkel when exhalation pressure exceeds a purge pressure; wherein normal exhalation pressure is sufficient to exceed the counter pressure, but is insufficient to exceed the purge pressure; and wherein an excessive exhalation pressure is greater than normal exhalation pressure and is sufficient to exceed the purge pressure.

9. The snorkel as in claim 1, further comprising a purge valve for purging water from the snorkel when exhalation pressure exceeds a purge pressure; wherein the purge pressure is greater than the counter pressure such that the exhalation pressure required to purge water from the snorkel is greater than the exhalation pressure required to exceed the counter pressure for a release of exhaled air from the chamber into the exhalation conduit.

10. The snorkel as in claim 1, wherein the counter pressure includes ambient water pressure and a biasing member.

11. A snorkel comprising (a) an inhalation conduit adapted to receive inhaled air in response to inhalation by a user of the snorkel, (b) a chamber adapted to receive and retain exhaled air from the user and further adapted to release exhaled air from the chamber when exhalation pressure in the chamber exceeds a counter pressure, (c) an exhalation conduit adapted to receive the released exhaled air from the chamber, the exhalation conduit being separate and distinct from the inhalation conduit, the exhalation conduit being sized and configured to allow the passage of air that is exhaled by the user and to direct the exhaled air out of the snorkel, and (d) a pressure system adapted to apply the counter pressure to the exhalation pressure in the chamber;

wherein the pressure system includes a pressure member comprised of a rigid support disk and a flexible support membrane;

wherein the pressure member is adapted, when acted upon by the counter pressure, to provide the counter pressure to the exhalation pressure in the chamber;

wherein the rigid support disk has purge channels to allow for purging of water from the snorkel;

wherein a purge pressure is required for purging of water through the purge channels; and wherein the purge pressure is greater than the counter pressure.

12. A device for controlling the flow of air being exhaled by a person, the device comprising:

an inlet passage for receiving the air being exhaled by a person;

a sealing element including a first portion at least partially disposed towards the inlet passage, the sealing element including a second portion that is at least partially disposed away from the inlet passage;

an exhalation pressure applied to the first portion of the sealing element when the person exhales;

a resistance pressure applied to the second portion of the sealing element;

a first outlet passage that is sized and configured to allow air to exit the device at a first rate, the first outlet passage being separate and distinct from the inlet passage, the first outlet passage being sized and configured to allow the passage of air that is exhaled by the person;

a second outlet passage that is sized and configured to allow air to exit the device at a second rate, the second outlet passage being separate and distinct from the inlet passage, the second outlet passage being sized and configured to allow the passage of air that is exhaled by the person;

a first position of the sealing element in which substantially no air flows through the first outlet passage or the second outlet passage, the sealing element being disposed in the first position when the exhalation pressure is less than the resistance pressure;

a second position of the sealing element in which air flows substantially through the first outlet passage, the sealing element being disposed in the second position when the exhalation pressure is greater than the resistance pressure; and a third position of the sealing element in which air flows substantially through the second outlet passage, the sealing element being disposed in the third position when the exhalation pressure is significantly greater than the resistance pressure;

wherein the air exiting the device at the second rate allows the device to be purged.

13. The device as in claim 12, wherein at least a portion of the resistance pressure is created by an ambient water pressure.

14. The device as in claim 12, wherein air can flow through the first outlet passage and the second outlet passage when the sealing element is in the third position.

15. The device as in claim 12, wherein the sealing element includes a flexible membrane.

16. The device as in claim 12, wherein the sealing element includes an exhalation valve and a purge valve.

17. The device as in claim 12, further comprising an inhalation conduit that is sized and configured to allow air to be inhaled by the person.

18. The device as in claim 17, further comprising an inhalation valve that is sized and configured to control the air entering and/or exiting the inhalation conduit.

19. The device as in claim 12, further comprising an exhalation conduit that is sized and configured to receive air flowing through the first outlet passage.

20. A device for controlling the flow of air, the device comprising:

an inlet passage;

an exhalation chamber that is sized and configured to receive and retain air exhaled by a person, the air within the exhalation chamber being disposed at an exhalation pressure;

a sealing element in communication with the exhalation chamber, the sealing element including a first portion and a second portion, the first portion of the sealing element being at least partially disposed towards the inlet passage, the second portion of the sealing element being at least partially disposed away from the inlet passage;

a first force applied to the first portion of the sealing element, the first force being at least partially created by the exhalation pressure;

a second force applied to the second portion of the sealing element;

a first outlet passage that is sized and configured to allow air to exit the device at a first rate, the first outlet passage being separate and distinct from the inlet passage, the first outlet passage being sized and configured to allow the passage of air that is exhaled by the person;

a second outlet passage that is sized and configured to allow air to exit the device at a second rate, the second outlet passage being separate and distinct from the inlet passage, the second outlet passage being sized and configured to allow the passage of air that is exhaled by the person;

a first position of the sealing element in which at least substantially no air flows through the first outlet passage or the second outlet passage, the sealing element being disposed in the first position when the first force applied to the sealing element is less than the second force applied to the sealing element;

a second position of the sealing element in which air flows substantially through the first outlet passage, the sealing element being disposed in the second position when the first force applied to the sealing element is greater than the second force applied to the sealing element; and a third position of the sealing element in which air flows substantially through the second outlet passage, the sealing element being disposed in the third position when the first force applied to the sealing element is much greater than the second force applied to the sealing element.

21. The device as in claim 20, wherein the second force is at least partially created by an water ambient pressure.

22. The device as in claim 20, wherein the air exiting the device at the second rate allows the device to be purged.

23. The device as in claim 20, wherein air can flow through the first outlet passage and the second outlet passage when the sealing element is in the third position.

24. The device as in claim 20, wherein the sealing element includes a flexible membrane.

25. The device as in claim 20, wherein the sealing element includes an exhalation valve and a purge valve.

26. The device as in claim 20, further comprising an inhalation conduit that is sized and configured to allow air to be inhaled by the person.

27. The device as in claim 20, further comprising an inhalation valve that is sized and configured to control the air entering and/or exiting the inhalation conduit.

28. The device as in claim 20, further comprising an exhalation conduit that is sized and configured to receive air flowing through the first outlet passage.

29. A snorkel comprising:

an inhalation conduit that is sized and configured to allow the passage of air which is inhaled by a user;

an exhalation conduit separate and distinct from the inhalation conduit, the exhalation conduit being sized and configured to allow the passage of air which is exhaled by the user;

a body including a chamber that is sized and configured to receive and retain exhaled air before the exhaled air enters the exhalation conduit;

an exhalation pressure created by the user exhaling;

an ambient water pressure created by disposing the snorkel in water; and a flexible sealing member which may be acted upon by the exhalation pressure and the ambient water pressure;

wherein the chamber receives and retains the exhaled air when the exhalation pressure does not exceed the ambient water pressure; and wherein the exhaled air is released from the chamber when the exhalation pressure exceeds the ambient water pressure.

30. The snorkel as in claim 29, further comprising a purge reservoir that is sized and configured to receive water entering the snorkel.

31. The snorkel as in claim 30, further comprising a purge valve through which the water in the purge reservoir may be purged from the snorkel.

32. The snorkel as in claim 29, further comprising an inhalation valve through which the inhaled air may enter the snorkel.

33. The snorkel as in claim 29, further comprising an exhalation valve through the exhaled air may exit the snorkel.

34. The snorkel as in claim 29, further comprising a mechanical pressure that may act upon the flexible sealing member in connection with the ambient water pressure.

35. An underwater breathing apparatus that is sized and configured to provide positive end expiratory pressure (PEEP) to a user, the underwater breathing apparatus comprising:

a chamber that is sized and configured to receive air exhaled by a user, the air within the chamber having an exhalation pressure, the chamber comprising:

an inlet that is sized and configured to receive air exhaled by the user;

a first outlet that is sized and configured to allow air to flow out of the chamber, the first outlet being separate and distinct from the inlet; and a second outlet that is sized and configured to allow air to flow out of the chamber, the second outlet being separate and distinct from the inlet and the first outlet; and an exhalation valve that controls the flow of air out of the chamber through the first opening and the second opening, the exhalation valve including an open position in which air can flow out of the chamber and a closed position in which air is at least substantially prevented from flowing out of the chamber;

wherein a force opening the valve is at least partially created by the exhalation pressure;

wherein a force closing the valve is at least partially created by ambient water pressure;

wherein the exhalation valve includes a first open position in which air at least substantially flows through the first outlet and not the second outlet; and wherein the exhalation valve includes a second open position in which air at least substantially flows through the first outlet and the second outlet.

36. The underwater breathing apparatus as in claim 35, wherein the force opening the valve is greater than the force closing the valve when the valve is in the first position; and wherein the force opening the valve is significantly greater than the force closing the valve when the valve is in the second position.

37. The underwater breathing apparatus as in claim 35, further comprising an inhalation conduit connected to the inlet; and further comprising an inhalation valve that allows air to flow into the chamber and substantially prevents air from flowing out of the chamber through the inhalation conduit.

38. The underwater breathing apparatus as in claim 35, wherein the breathing apparatus is part of a snorkel.

39. The underwater breathing apparatus as in claim 35, wherein the breathing apparatus is part of a breathing regulator.

40. The underwater breathing apparatus as in claim 35, wherein the exhalation valve is biased into the closed position.

41. The underwater breathing apparatus as in claim 35, wherein the exhalation valve further comprises:

a rigid support member; and a membrane that is movable between an open position in which air can flow through the exhalation valve and a closed position in which air flow through the exhalation valve is at least substantially prevented.

42. The underwater breathing apparatus as in claim 35, further comprising an exhalation conduit in fluid communication with the first outlet and an inhalation conduit in fluid communication with the inlet;

wherein the exhalation conduit is at least partially disposed within the inhalation conduit.

43. An underwater breathing apparatus that is sized and configured to provide positive end expiratory pressure (PEEP) to a user, the underwater breathing apparatus comprising:

a chamber that is sized and configured to receive air exhaled by a user, the air within the chamber having an exhalation pressure, the chamber comprising:

an inlet that is sized and configured to receive air exhaled by the user;

a first outlet that is sized and configured to allow air to flow out of the chamber, the first outlet being separate and distinct from the inlet; and a second outlet that is sized and configured to allow air to flow out of the chamber, the second outlet being separate and distinct from the inlet and the first outlet; and an exhalation valve that controls the flow of air out of the chamber through the first opening and the second opening, the exhalation valve including an open position in which air can flow out of the chamber and a closed position in which air is at least substantially prevented from flowing out of the chamber;

wherein a force opening the valve is at least partially created by the exhalation pressure;

wherein a force closing the valve is at least partially created by ambient water pressure;

wherein the exhalation valve further comprises a membrane that is movable between an open position in which air can flow through the second opening in the chamber and a closed position in which air flow through the second opening in the chamber is at least substantially prevented.

* * * * *

UNITED STATES PATENT AND TRADEMARK OFFICE

CERTIFICATE OF CORRECTION

PATENT NO. : 7,793,656 B2
APPLICATION NO. : 10/453462
DATED : September 14, 2010
INVENTOR(S) : Johnson It is certified that error appears in the above-identified patent and that said Letters Patent is hereby corrected as shown below:

On the Title Page

Item 73, Assignee, remove [Lifetime Products, Inc., Clearfield, UT (US)]

Item 56, References Cited, OTHER PUBLICATIONS, change "Fee et al., "Cardiorespiratory responses to increased expiratory resistance during excercise", Lung Mechanics, 5032." to --Fee et al., "Cardiorespiratory responses to increased expiratory resistance during exercise," Lung Mechanics, 5032.--

Item 57, ABSTRACT, Lines 2-3, remove carriage return

Column 3

Line 24, after "at the top end of" insert --the--

Column 4

Line 6, change "invention" to --invention,--

Line 38, change "incorporate" to --incorporated--

Column 6

Line 64, change "housing" to --housing,--

Column 7

Line 36, after "experienced" insert --.--

Line 66, after "snorkel" insert --.--

Line 67, after "snorkel" insert --.--

Column 8

Line 6, after "inhalation" insert --.--

Line 9, after "exhalation" insert --.--

Line 11, after "structures" insert --.--

Line 14, after "mount" insert --.--

Line 16, after "tube" insert --.--

Signed and Sealed this
Seventh Day of June, 2011

David J. Kappos

David J. Kappos
*Director of the United States Patent and Trademark Office*

Line 25, after "assembly" insert --.--
Line 27, after "assembly" insert --.--
Line 34, after "exhalation" insert --.--
Line 36, after "exhalation" insert --.--
Line 65, after "Purge Valve 5" remove [is]

Column 9
Line 23, change "Combine Sealing Assembly" to --Combine Sealing Assembly 6--
Line 26, change "Exhalation Tube" to --Exhalation Tube 48--
Line 39, change "Inhalation Valve 1" to --Inhalation Valve 3--
Line 40, change "Exhalation Valve 2" to --Exhalation Valve 4--
Line 55, change "Inhalation Cap" to --Inhalation Cap 7--

Column 10
Line 48, change "[17]" to --17--
Line 49, change "[13]" to --13--
Line 67, after "(shown in FIG. 5A)" insert --.--

Column 11
Lines 30-31, change "(which is shown in FIGS. 6A, 6B, and 6C)" to --(which is shown in FIGS. 7A, 7B, and 7C)--
Line 42, change "Pure Cap 50" to --Purge Cap 50--

Column 12
Line 63, after "an" remove [the]

Column 13
Line 1, change "FIG. 5C, except that FIG. 5D" to --FIG. 6A, except that FIG. 6B--
Line 26, change "form" to --from--
Line 38, change "Juntion 75" to --Junction 75--
Line 45, change "optinal" to --optional--
Line 61, change "Flow Arrows 75" to --Flow Arrows 96.--
Line 65, after "65" remove [is]

Column 14
Line 9, change "Exhalation Tube" to --Exhalation Tube 86--
Line 10, change "Sealing Cup 80" to --Sealing Cup 81--
Line 11, before "a" remove [the]
Line 12, after "Support" remove [ 81]
Line 13, change "Chamber" to --Chamber 80--
Lines 17-18, change "External Exhalation Tube Mount 85" to --External Exhalation Tube mount 84--
Line 23, change "Exhalation Valve [4]" to --Exhalation Valve 4--
Line 34, change "scuba The" to --scuba. The--

Lines 36-37, change "to the Ribbed 90 Connecting Tube 89" to --to the Ribbed Portion 90 of the Connecting Tube Mount 89--
Line 42, after "is" insert --a--
Line 47, change "22]" to --22--

Column 17
Line 62, change "by an water ambient pressure" to --by an ambient water pressure--

Column 18
Line 45, change "through the exhaled air" to --through which the exhaled air--